US011644765B2

(12) United States Patent
Hara

(10) Patent No.: US 11,644,765 B2
(45) Date of Patent: May 9, 2023

(54) IMAGE FORMING APPARATUS CAPABLE OF CORRECTING DENSITY UNEVENNESS OF AN IMAGE

(71) Applicant: FUJIFILM BUSINESS INNOVATION CORP., Tokyo (JP)

(72) Inventor: Kenji Hara, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/539,890

(22) Filed: Dec. 1, 2021

(65) Prior Publication Data

US 2023/0065529 A1 Mar. 2, 2023

(30) Foreign Application Priority Data

Aug. 25, 2021 (JP) ..... JP2021-137640

(51) Int. Cl.
*G03G 15/043* (2006.01)
*G03G 15/00* (2006.01)

(52) U.S. Cl.
CPC ..... *G03G 15/043* (2013.01); *G03G 15/5058* (2013.01)

(58) Field of Classification Search
CPC ..... G03G 15/043; G03G 15/5058
See application file for complete search history.

(56) References Cited

U.S. PATENT DOCUMENTS

2014/0268242 A1* 9/2014 Kaneko ..... G03G 15/5058 358/3.21
2015/0362879 A1* 12/2015 Kaneko ..... G03G 15/5058 399/49
2017/0017177 A1* 1/2017 Iwata ..... G03G 15/043

FOREIGN PATENT DOCUMENTS

JP 2012-108454 A 6/2012
JP 2012-255834 A 12/2012

* cited by examiner

*Primary Examiner* — Sandra Brase
(74) *Attorney, Agent, or Firm* — Oliff PLC

(57) ABSTRACT

An image forming apparatus includes: an output section that forms an electrostatic latent image onto an image carrier by using light emitted by a light source and outputs an image onto a recording medium by developing the formed electrostatic latent image; a memory that stores a sinusoidal set value representing a correction amount for correcting periodic density variations that occur in an image, which is to be formed, in a subscanning direction and that are caused by a rotating body, and a correction table in which correction amounts for correcting density variations that occur in an image, which is to be formed, in the subscanning direction and that are not caused by a rotating body are each stored in association with a corresponding position in the subscanning direction; and a processor configured to: calculate a first correction amount corresponding to a rotation phase of a rotating body included in the output section on a basis of the sinusoidal set value and retrieve a second correction amount corresponding to a position in the subscanning direction from the correction table when an image is formed in the output section; and perform, by using the calculated first correction amount and the retrieved second correction amount, correction of a density of an image that is formed onto a recording medium.

12 Claims, 20 Drawing Sheets

FIG. 10

| DIRECTION OF DENSITY UNEVENNESS | SYNCHRONIZING SIGNAL | DENSITY OF CORRECTION TARGET | CORRECTION-AMOUNT STORING METHOD | CORRECTION METHOD |
|---|---|---|---|---|
| SCANNING DIRECTION DURING LIGHT EXPOSURE (MAIN SCANNING DIRECTION) | START-OF-SCAN SIGNAL | Cin = 100% (SOLID DENSITY) | CORRECTION TABLE | LIGHT EXPOSURE |
| | | Cin ≠ 100% (HALFTONES) | CORRECTION TABLE | PIXEL VALUE |
| SHEET-TRANSPORT DIRECTION (SUBSCANNING DIRECTION) | TOP-OF-PAGE SIGNAL | Cin = 100% (SOLID DENSITY) | CORRECTION TABLE | LIGHT EXPOSURE |
| | | Cin ≠ 100% (HALFTONES) | CORRECTION TABLE | PIXEL VALUE |
| SHEET-TRANSPORT DIRECTION (SUBSCANNING DIRECTION) | Z-PHASE SIGNAL OF PHOTOCONDUCTOR ROLLER | Cin = 100% (SOLID DENSITY) | SINUSOIDAL PARAMETER | LIGHT EXPOSURE |
| | | Cin ≠ 100% (HALFTONES) | SINUSOIDAL PARAMETER | PIXEL VALUE |
| SHEET-TRANSPORT DIRECTION (SUBSCANNING DIRECTION) | Z-PHASE SIGNAL OF DEVELOPING ROLLER | Cin = 100% (SOLID DENSITY) | SINUSOIDAL PARAMETER | LIGHT EXPOSURE |
| | | Cin ≠ 100% (HALFTONES) | SINUSOIDAL PARAMETER | PIXEL VALUE |

FIG. 16

| DIRECTION OF DENSITY UNEVENNESS | SYNCHRONIZING SIGNAL | DENSITY OF CORRECTION TARGET | CORRECTION-AMOUNT STORING METHOD | CORRECTION METHOD |
|---|---|---|---|---|
| SCANNING DIRECTION DURING LIGHT EXPOSURE (MAIN SCANNING DIRECTION) | START-OF-SCAN SIGNAL | Cin = 100% (SOLID DENSITY) | CORRECTION TABLE | LIGHT EXPOSURE |
| | | Cin ≠ 100% (HALFTONES) | CORRECTION TABLE | PIXEL VALUE |
| SHEET-TRANSPORT DIRECTION (SUBSCANNING DIRECTION) | TOP-OF-PAGE SIGNAL | Cin = 100% (SOLID DENSITY) | CORRECTION TABLE | LIGHT EXPOSURE |
| | | Cin ≠ 100% (HALFTONES) | CORRECTION TABLE | PIXEL VALUE |
| SHEET-TRANSPORT DIRECTION (SUBSCANNING DIRECTION) | Z-PHASE SIGNAL OF PHOTOCONDUCTOR ROLLER | Cin = 100% (SOLID DENSITY) | CORRECTION TABLE | LIGHT EXPOSURE |
| | | Cin ≠ 100% (HALFTONES) | SINUSOIDAL PARAMETER | PIXEL VALUE |
| SHEET-TRANSPORT DIRECTION (SUBSCANNING DIRECTION) | Z-PHASE SIGNAL OF DEVELOPING ROLLER | Cin = 100% (SOLID DENSITY) | CORRECTION TABLE | LIGHT EXPOSURE |
| | | Cin ≠ 100% (HALFTONES) | SINUSOIDAL PARAMETER | PIXEL VALUE |

IMAGE FORMING APPARATUS CAPABLE OF CORRECTING DENSITY UNEVENNESS OF AN IMAGE

CROSS-REFERENCE TO RELATED APPLICATIONS

This application is based on and claims priority under 35 USC 119 from Japanese Patent Application No. 2021-137640 filed Aug. 25, 2021.

BACKGROUND

(i) Technical Field

The present disclosure relates to an image forming apparatus.

(ii) Related Art

Japanese Unexamined Patent Application Publication No. 2012-108454 discloses an image forming apparatus that determines, on the basis of an output signal of a density sensor that detects density variations occurred in an output image in a subscanning direction and an output signal of a drum-period detection sensor, a periodic pattern of a sine wave representing density variations in the subscanning direction and performs density correction by using the periodic pattern.

Japanese Unexamined Patent Application Publication No. 2012-255834 discloses an image processing apparatus that creates and stores beforehand a correction table in which correction amounts for correcting density variations that occur due to a device employing an electrophotographic system in such a manner as to perform a periodic movement when an image is formed by using this device are each calculated so as to correspond to a rotation phase, the image processing apparatus being configured to perform density correction by using a correction amount based on the correction table and output the image when the image processing apparatus forms an image.

SUMMARY

Aspects of non-limiting embodiments of the present disclosure relate to providing an image forming apparatus capable of correcting irregular density unevenness other than periodic density unevenness that occur in an image, which is to be formed, in a subscanning direction and reducing the amount of data required to be stored compared with the case of using a correction table in which correction amounts for correcting all the density unevennesses in the subscanning direction are each stored in association with a corresponding position in the subscanning direction or a corresponding rotation phase of a rotating body.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an output section that forms an electrostatic latent image onto an image carrier by using light emitted by a light source and outputs an image onto a recording medium by developing the formed electrostatic latent image; a memory that stores a sinusoidal set value representing a correction amount for correcting periodic density variations that occur in an image, which is to be formed, in a subscanning direction and that are caused by a rotating body, and a correction table in which correction amounts for correcting density variations that occur in an image, which is to be formed, in the subscanning direction and that are not caused by a rotating body are each stored in association with a corresponding position in the subscanning direction; and a processor configured to: calculate a first correction amount corresponding to a rotation phase of a rotating body included in the output section on a basis of the sinusoidal set value and retrieve a second correction amount corresponding to a position in the subscanning direction from the correction table when an image is formed in the output section; and perform, by using the calculated first correction amount and the retrieved second correction amount, correction of a density of an image that is formed onto a recording medium.

BRIEF DESCRIPTION OF THE DRAWINGS

Exemplary embodiments of the present disclosure will be described in detail based on the following figures, wherein:

FIG. 10 is a table illustrating examples of combinations of a direction of density unevenness, the density of a correction target, a correction-amount storing method, and a correction method when density unevenness correction is performed;

FIG. 16 is a table illustrating examples of combinations of a direction of density unevenness, the density of a correction target, a correction-amount storing method, and a correction method at the time of performing density unevenness correction such as density correction of periodic density unevenness in a solid density in the subscanning direction that is performed by using a correction table;

DETAILED DESCRIPTION

Exemplary embodiments of the present disclosure will be described in detail below with reference to the drawings.

Figure 1:
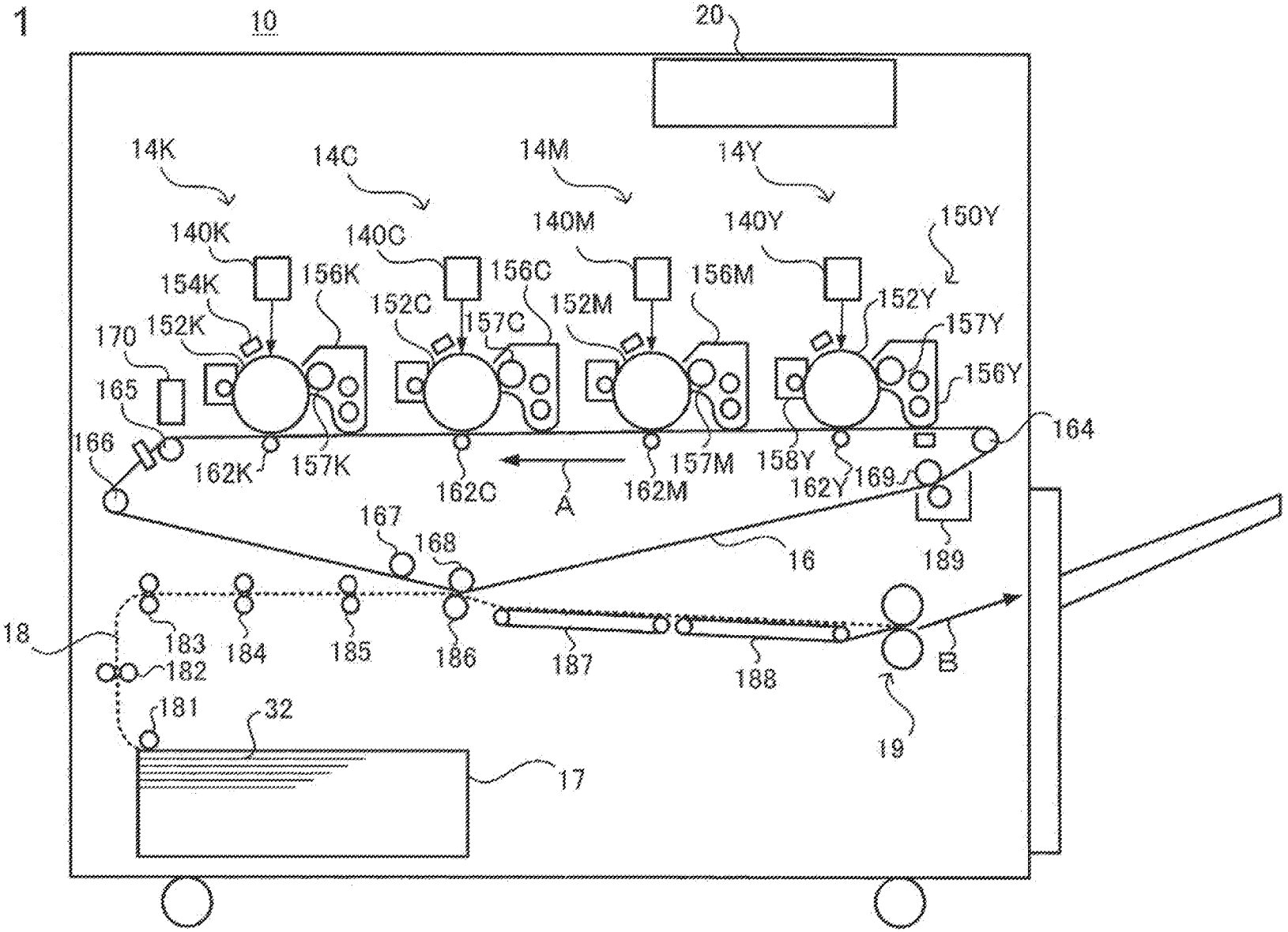
FIG. 1 is a diagram illustrating the configuration of an image forming apparatus according to an exemplary embodiment of the present disclosure.

FIG. 1 is a diagram illustrating the configuration of an image forming apparatus 10 according to an exemplary embodiment of the present disclosure.

As illustrated in FIG. 1, the image forming apparatus 10 includes image forming units 14K, 14C, 14M, and 14Y, an intermediate transfer belt 16, a sheet tray 17, a sheet transport path 18, a fixing unit 19, and a controller 20. The image forming apparatus 10 has a printer function that prints image data, which is received from a personal computer (not illustrated) or the like.

First, an overview of the image forming apparatus 10 will be described. The controller 20 is positioned in an upper portion of the image forming apparatus 10. The controller 20 performs image processing such as gradation correction and resolution correction on image data input from a personal computer (not illustrated) or the like via a network line, such as a LAN, and then outputs the image data to the image forming units 14.

The four image forming units 14K, 14C, 14M, and 14Y are arranged below the controller 20 such that each of the four image forming units 14K, 14C, 14M, and 14Y corresponds to one of the colors of color images. In the present exemplary embodiment, the four image forming units 14K, 14C, 14M, and 14Y that correspond to black (K), cyan (C), magenta (M), and yellow (Y), respectively, are horizontally arranged along the intermediate transfer belt 16 in such a manner as to be spaced apart from one another by a certain distance. The intermediate transfer belt 16 serves as an intermediate transfer body and moves along a circular path in the direction of arrow A in FIG. 1. The four image forming units 14K, 14Y, 14M, and 14C sequentially form toner images of their respective colors on the basis of image data input from the controller 20 and transfer (in a first transfer process) these toner images onto the intermediate transfer belt 16 at the timing at which the toner images are superposed with one another. Note that the image forming units 14K, 14C, 14M, and 14Y are not limited to being arranged in the order of colors black (K), cyan (C), magenta (M), and yellow (Y) and may be in any order (e.g., yellow (Y), magenta (M), cyan (C), and black (K)).

The sheet transport path 18 is disposed below the intermediate transfer belt 16. A recording sheet 32 that is supplied from the sheet tray 17 is transported along the sheet transport path 18, and the toner images of the different colors, which have been transferred to the intermediate transfer belt 16 in such a manner as to be superposed with one another, are collectively transferred (in a second transfer process) onto the recording sheet 32. Then, the transferred toner images are fixed onto the recording sheet 32 by the fixing unit 19, and the recording sheet 32 is ejected to the outside in the direction of arrow B.

The configuration of each component of the image forming apparatus 10 will now be described in further detail.

The controller 20 performs predetermined image processing such as shading correction, lightness/color space conversion, and gamma correction on image data input thereto. Note that, in the case where the input image data contains data components of, for example, red (R), green (G), and blue (B) each of which is composed of eight bits, these data components are converted into, through the image processing performed by the controller 20, document-color-material-gradation data components, each of which has one of four colors of black (K), cyan (C), magenta (M), and yellow (Y) and each of which is composed of 8 bits.

The image forming units (image forming units) 14K, 14C, 14M, and 14Y are arranged side by side in the horizontal direction in such a manner as to be spaced apart from one another by a certain distance, and the configurations of the image forming units 14K, 14C, 14M, and 14Y are substantially similar to one another except for the colors of images formed thereby. Accordingly, the image forming unit 14K will be described below. Note that the configurations of the image forming units 14 are distinguished from one another by adding the letters K, C, M, and Y to the reference signs.

The image forming unit 14K includes an exposure unit 140K that radiates light onto an image forming device 150Y in accordance with image data, which is input from the controller 20, and the image forming device 150Y on which an electrostatic latent image is formed by a laser beam that is caused to scan the image forming device 150Y by the exposure unit 140K.

The exposure unit 140K exposes a photoconductor roller 152K of the image forming device 150Y to light by radiating a laser beam that corresponds to black (K) image data onto the photoconductor roller 152K so as to form an electrostatic latent image onto the photoconductor roller 152K. Note that the exposure unit 140K includes a plurality of bar-shaped LED print heads (LPHs) in each of which a plurality of LEDs, which are light emitting elements, are arranged. Details of the configuration of the exposure unit 140K will be described later.

The image forming device 150Y includes the photoconductor roller 152K that performs a rotational movement in the direction of arrow A at a predetermined rotational speed, a charging device 154K serving as a charging unit that uniformly charges a surface of the photoconductor roller 152K, a developing device 156K that develops an electrostatic latent image formed on the photoconductor roller 152K, and a cleaning device 158Y. The photoconductor roller 152K is an image carrier that has a tubular shape and that holds an image, which has been developed with a developer such as toner, and is uniformly charged by the charging device 154K, and an electrostatic latent image is formed on the photoconductor roller 152K by the laser beam radiated from the exposure unit 140K. An electrostatic latent image formed on the photoconductor roller 152K is developed by the developing device 156K with a developer such as black (K) toner and transferred onto the intermediate transfer belt 16. Note that residual toner, paper dust, and the like that remain on the photoconductor roller 152K after a process of transferring a toner image (a developer image) has been executed are removed by the cleaning device 158Y.

Similar to the image forming unit 14K, the image forming unit 14C includes a photoconductor roller 152C and a developing device 156C and forms a cyan (C) toner image. The image forming unit 14M includes a photoconductor roller 152M and a developing device 156M and forms a magenta (M) toner image. The image forming unit 14Y includes a photoconductor roller 152Y and a developing device 156Y and forms a yellow (Y) toner image. These toner images of the different colors are transferred onto the intermediate transfer belt 16.

The intermediate transfer belt 16 is stretched by a drive roller 164, idle rollers 165, 166, and 167, a backup roller 168, and an idle roller 169 with a certain tension and is driven so as to rotate in the direction of arrow A at a predetermined speed as a result of the drive roller 164 being driven by a drive motor (not illustrated) so as to rotate. The intermediate transfer belt 16 has the form of an endless belt obtained by, for example, forming a flexible film made of a synthetic resin, such as a polyimide, into a belt-like shape and joining the two ends of the synthetic resin film, which has a belt-like shape, to each other by welding or the like.

First transfer rollers 162K, 162C, 162M, and 162Y are arranged at positions on the intermediate transfer belt 16 at which the first transfer rollers 162K, 162C, 162M, and 162Y face the image forming units 14K, 14C, 14M, and 14Y, respectively. Toner images of the different colors that are formed on the photoconductor rollers 152K, 152C, 152M, and 152Y are transferred onto the intermediate transfer belt 16 in such a manner as to be superposed with one another by the first transfer rollers 162. Note that residual toner that remains on the intermediate transfer belt 16 is removed by a cleaning blade or a brush of a belt cleaning device 189 that is disposed at a position downstream from a second transfer position.

A density sensor 170 is disposed in the vicinity of the intermediate transfer belt 16. The density sensor 170 is a density detection unit that detects the density of a toner image transferred to the intermediate transfer belt 16.

A sheet feed roller 181 that picks up the recording sheet 32 from the sheet tray 17, a first pair of rollers 182, a second pair of rollers 183, and a third pair of rollers 184 each pair of which is used for transporting sheets, and registration rollers 185 that transport the recording sheet 32 to the second transfer position at a predetermined timing are arranged on the sheet transport path 18.

A second transfer roller 186 that is pressed into contact with the backup roller 168 is disposed at the second transfer position on the sheet transport path 18, and toner images of the different colors, which have been transferred to the intermediate transfer belt 16 in such a manner as to be superposed with one another, are transferred in the second transfer process onto the recording sheet 32 with a press-contact force and an electrostatic force exerted by the second transfer roller 186. The recording sheet 32, to which the toner images of the different colors have been transferred, is transported to the fixing unit 19 by a transport belt 187 and a transport belt 188.

The fixing unit 19 performs a heat treatment and a pressure treatment on the recording sheet 32, to which the toner images of the different colors have been transferred, so as to cause the toners to melt and become fixed onto the recording sheet 32.

Note that the developing device 156K includes a developing roller (developer transport unit) 157K that has a tubular shape, and the developing roller 157K transports the developer to the photoconductor roller 152K by performing a rotational movement so as to form a developer image onto the photoconductor roller 152K. Similarly, in the image forming units 14C, 14M, and 14Y, which form images of the other colors, the developing devices 156C, 156M, and 156Y each include a developing roller 157C, 157M and 157Y.

The image forming apparatus 10 of the present exemplary embodiment having a configuration such as that described above employs an electrophotographic system and forms an image onto a recording medium such as a printing sheet. The image forming units 14, the intermediate transfer belt 16, the fixing unit 19, and so forth that have been described above form an output section, and this output section forms electrostatic latent images onto the photoconductor rollers 152, each of which is an image carrier, by light radiated from a light source and outputs an image onto a recording medium by developing the formed electrostatic latent images.

However, since the image forming apparatus 10 of the present exemplary embodiment performs image formation by using rotating bodies such as the photoconductor rollers 152 and the developing rollers 157, periodic density unevenness (density variations) may sometimes occur in a subscanning direction, which is a sheet-transport direction.

Figure 2:
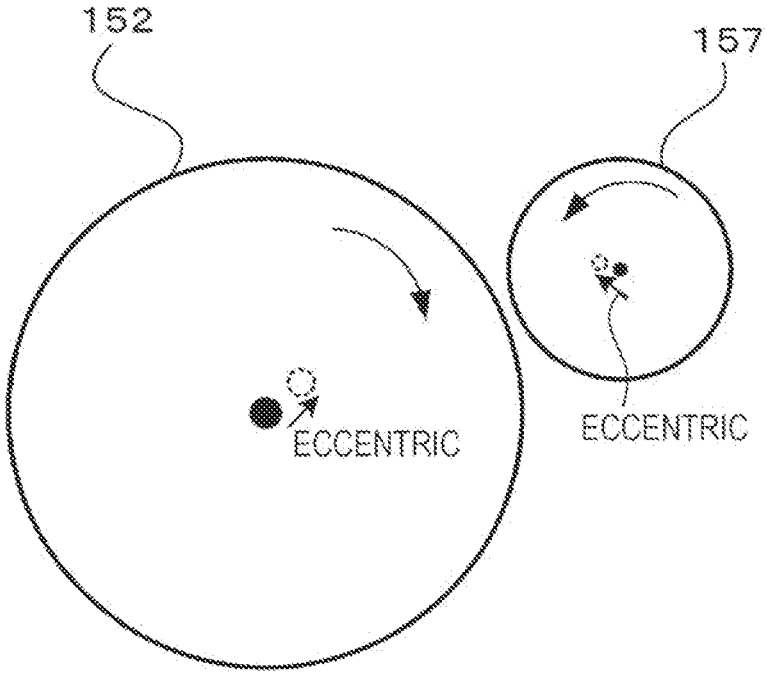
FIG. 2 is a diagram illustrating the positional relationship between a photoconductor roller and a developing roller.

For example, FIG. 2 illustrates the positional relationship between one of the photoconductor rollers 152 and the corresponding developing roller 15.

As illustrated in FIG. 2, the photoconductor roller 152 and the developing roller 157 are arranged in such a manner as to face each other with a predetermined space (gap) formed therebetween. The developing roller 157 holds the developer on its surface by a magnetic force of a magnet that is disposed within the developing roller 157 and transports the developer, which is held on the surface thereof, to the gap between the photoconductor roller 152 and the developing roller 157 by performing a rotational movement so as to develop an electrostatic latent image formed on the surface of the photoconductor roller 152 into a visible image.

However, in the case where the rotation axis of the photoconductor roller 152 or the rotation axis of the developing roller 157 is displaced from and eccentric to an ideal rotation axis, the gap between the photoconductor roller 152 and the developing roller 157 changes periodically. A similar problem occurs in the case where the photoconductor roller 152 and the developing roller 157 are not arranged so as to be completely parallel to each other. In addition, a similar problem occurs also in the case where the shape of the photoconductor roller 152 or the shape of the developing roller 157 is distorted or deformed.

In an image that is formed with the occurrence of such a problem, periodic density unevenness may sometimes occur in the subscanning direction.

Figure 3:
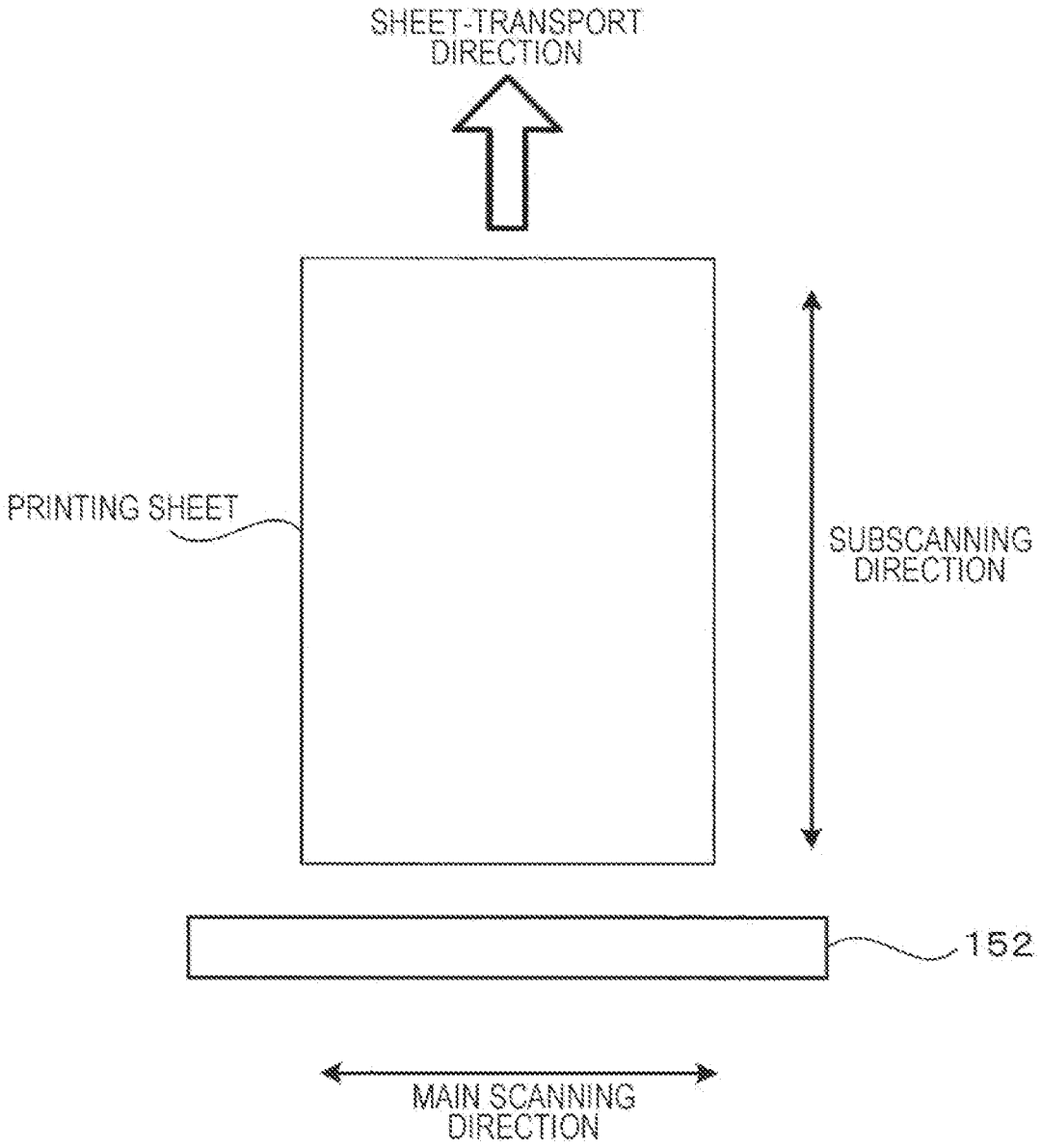
FIG. 3 is a diagram illustrating directions that relate to an image to be formed and to the arrangement of the image forming apparatus.

Directions that relate to an image to be formed and to the arrangement of the image forming apparatus 10 will now be described with reference to FIG. 3. As illustrated in FIG. 3, a direction in which each of the exposure units 140 causes a laser beam to scan, that is, the longitudinal direction of each of the photoconductor rollers 152, will hereinafter be referred to as a main scanning direction. In addition, a direction that is perpendicular to the main scanning direction, that is, a sheet-transport direction in which a printing sheet or the like is transported will hereinafter be referred to as the subscanning direction.

Figure 4:
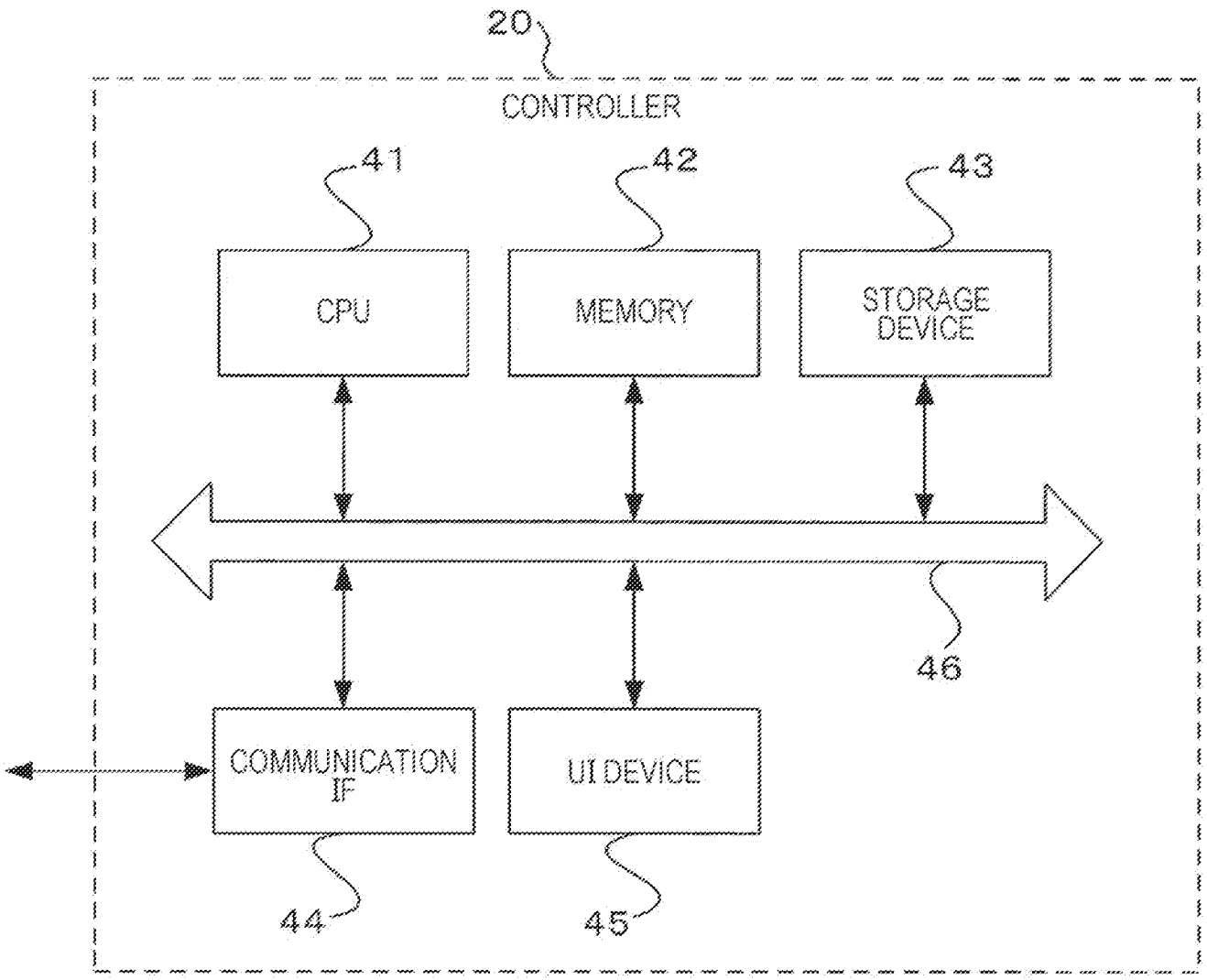
FIG. 4 is a block diagram illustrating the hardware configuration of a controller that controls the operation of the image forming apparatus according to the exemplary embodiment of the present disclosure.

FIG. 4 illustrates the hardware configuration of the controller 20 that controls the operation of the image forming apparatus 10 of the present exemplary embodiment.

As illustrated in FIG. 4, the controller 20 includes a CPU 41, memory 42, a storage device 43 such as a hard disk drive, a communication interface 44 that performs transmission and reception of data with, for example, an external device via a network, and a user interface (hereinafter abbreviated to "UI") device 45 that includes a touch panel or a liquid crystal display and a keyboard. These components are connected to one another via a control bus 46.

The CPU 41 is a processor that controls the operation of the controller 20 by performing predetermined processing on the basis of a control program stored in the memory 42 or the storage device 43. Note that, in the present exemplary embodiment, although the CPU 41 is configured to read and run a control program stored in the memory 42 or the storage device 43, the program may be provided to the CPU 41 by being stored in a storage medium such as a compact disc read-only memory (CD-ROM).

Figure 5:
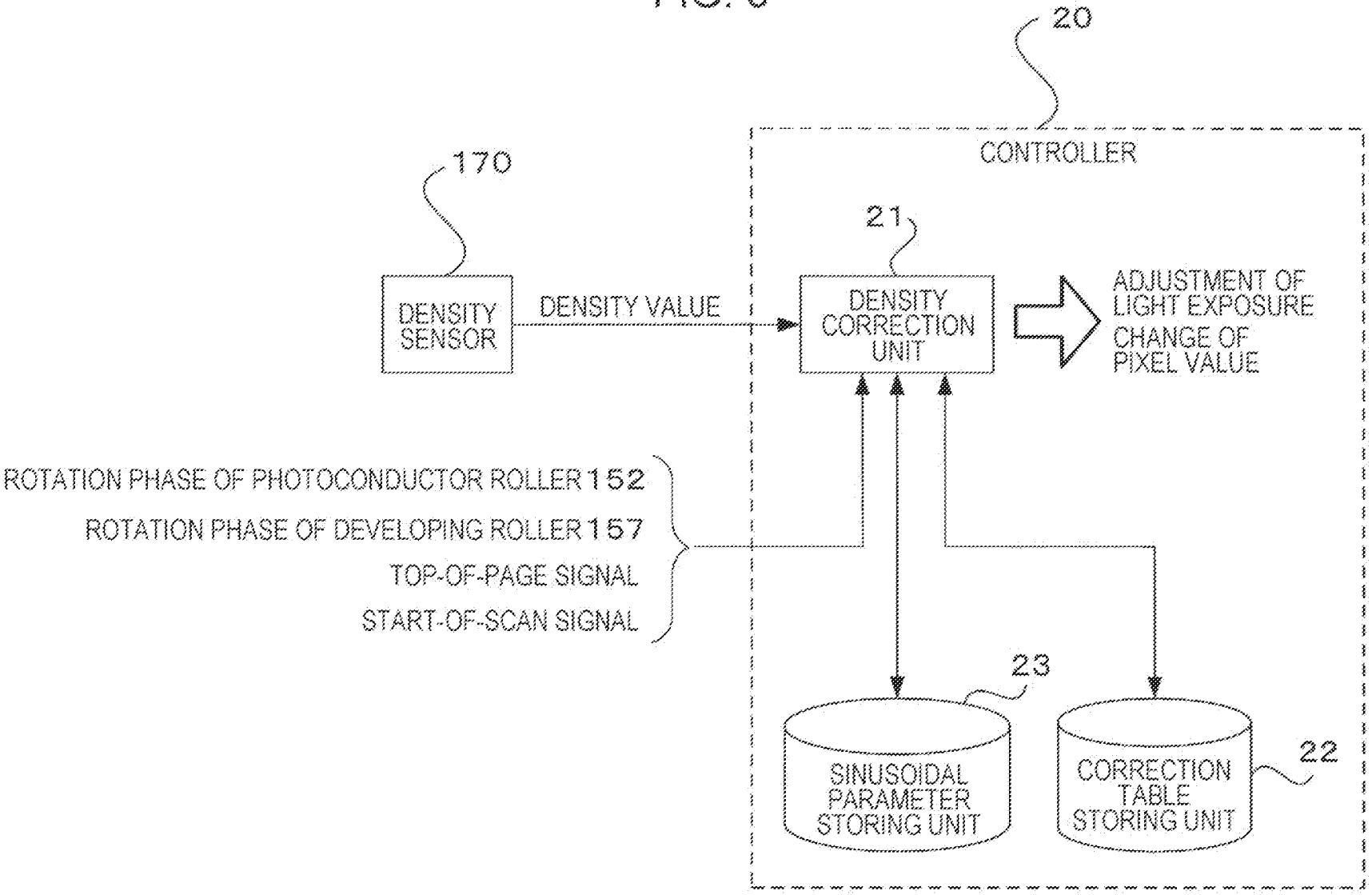
FIG. 5 is a block diagram illustrating the functional configuration of the controller illustrated in FIG. 4.

FIG. 5 is a block diagram illustrating the functional configuration of the controller 20 illustrated in FIG. 4 that is constructed by running the above-mentioned control program.

As illustrated in FIG. 5, the controller 20 includes a density correction unit 21, a correction table storing unit 22, and a sinusoidal parameter storing unit 23.

The density correction unit 21 detects density unevenness occurred in an output image on the basis of density information such as a density value detected by the density sensor 170 and adjusts the light exposure of each of the exposure units 140 or changes a pixel value used when an image is formed so as to suppress the detected density unevenness. Note that, the density correction unit 21 determines a position in an image at which such density correction is performed on the basis of rotation phase information such as a Z-phase signal of each of the photoconductor rollers 152, rotation phase information such as a Z-phase signal of each of the developing rollers 157, a top-of-page signal, and a start-of-scan signal.

Here, if correction of density unevenness is performed by using a correction table in which correction amounts are each stored in association with a corresponding position in the subscanning direction, finer density variations may be accurately corrected. However, in the case of correcting all the density unevennesses in the subscanning direction by using such a correction table, it is necessary to store beforehand a correction table corresponding to the rotation phase of each of the photoconductor rollers 152, a correction table corresponding to the rotation phase of each of the developing rollers 157, a correction table corresponding to each page position, and so forth. Thus, this case has an undesirable effect of increasing the amount of data required to be stored.

In the case of correcting density unevenness by using a correction amount represented by a sinusoidal parameter, the accuracy with which the density unevenness is corrected may sometimes be lower than that in the case of correcting density unevenness by using a correction table. In addition, it is difficult to correct more irregular density unevenness occurred due to collision between a sheet and a member by using a sinusoidal parameter.

Accordingly, in the present exemplary embodiment, density correction using a sinusoidal parameter (a sinusoidal set value) is performed on periodic density variations that occur in the subscanning direction due to a rotating body, and density correction using a correction table is performed on density variations that occur in the subscanning direction not due to a rotating body.

The sinusoidal parameter storing unit 23 stores a sinusoidal parameter (a sinusoidal set value) representing a correction amount for correcting periodic density variations that occur in an image, which is to be formed, in the subscanning direction and that are caused by a rotating body.

The correction table storing unit 22 stores a correction table in which correction amounts for correcting density variations that occur in an image, which is to be formed, in the subscanning direction and that are not caused by a rotating body are each stored in association with a corresponding position in the subscanning direction.

The density correction unit 21 extracts a sinusoidal parameter representing periodic variations in density unevenness that is detected on the basis of a density value obtained by the density sensor 170 and stores a sinusoidal parameter that has a characteristic of canceling the extracted sinusoidal parameter in the sinusoidal parameter storing unit 23 as a correction amount for the correcting density unevenness.

In addition, the density correction unit 21 creates a correction table in which correction amounts for correcting density variations other than periodic density variations in density unevenness that is detected on the basis of a density value obtained by the density sensor 170 are each stored in association with a corresponding position in the subscanning direction and stores the correction table into the correction table storing unit 22.

When an image is formed in the image output section, the density correction unit 21 calculates, on the basis of a sinusoidal parameter, a first correction amount that corresponds to the rotation phase of a rotating body such as each of the photoconductor rollers 152 or each of the developing rollers 157 and obtains a second correction amount that corresponds to a position in the subscanning direction from the correction table stored in the correction table storing unit 22.

When an image is formed onto a recording medium, the density correction unit 21 performs density correction on the image that is formed onto the recording medium by using the calculated first correction amount and the obtained second correction amount.

Note that, regarding density correction for correcting density unevenness, the density correction that is performed in the case of correcting density variations that occur near a highest density and the density correction that is performed in the case of correcting density variations in halftones are different from each other.

Thus, in order to reduce the amount of data given a top priority to be stored, density corrections may be performed, for periodic density unevenness in the subscanning direction that is caused by a rotating body, on both density variations that occur near the highest density and density variations in halftones by using a correction amount using a sinusoidal parameter.

More specifically, the density correction unit 21 performs density correction using the first correction amount, which is calculated on the basis of a sinusoidal parameter, both in the case of correcting density variations in halftones that occur in the subscanning direction due to a rotating body and in the case of correcting density variations that occur near the highest density.

When the density correction unit 21 performs correction of a halftone density by using the first correction amount, the density correction unit 21 performs the density correction by changing a pixel value in an image to be formed, and when the density correction unit 21 performs density correction near the highest density by using the first correction amount, the density correction unit 21 performs the density correction by changing the light exposure of each of the exposure units 140.

In the case where it is desired to perform more accurate density correction on density variations that occur near the highest density, a correction amount for correcting density variations that occur near the highest density among periodic density variations that occur in an image, which is to be formed, in the subscanning direction and that are caused by a rotating body may be stored in the correction table, which is stored in the correction table storing unit 22, in association with the rotation phase of the rotating body.

In this case, the density correction unit 21 performs density correction using the first correction amount, which is calculated on the basis of a sinusoidal parameter, in the case of correcting density variations in halftones that occur in the subscanning direction due to a rotating body and performs density correction using the second correction amount, which is retrieved from the correction table in accordance with the rotation phase of the rotating body, in the case of correcting density variations that occur near the highest density.

When the density correction unit 21 performs density correction using the first correction amount, the density correction unit 21 performs the density correction by changing a pixel value in an image to be formed, and when the density correction unit 21 performs density correction on density variations caused by a rotating body by using the second correction amount, the density correction unit 21 performs the density correction by changing the light exposure of each of the exposure units 140 in the image output section.

Note that the rotating body that causes density unevenness to occur in an image, which is to be formed, in the subscanning direction is specifically at least one of the photoconductor rollers 152 or at least one of the developing rollers 157.

The operation of the density correction unit 21 when the density correction unit 21 performs density correction in the image forming apparatus 10 of the present exemplary embodiment will now be described in detail with reference to the drawings.

Figure 6:
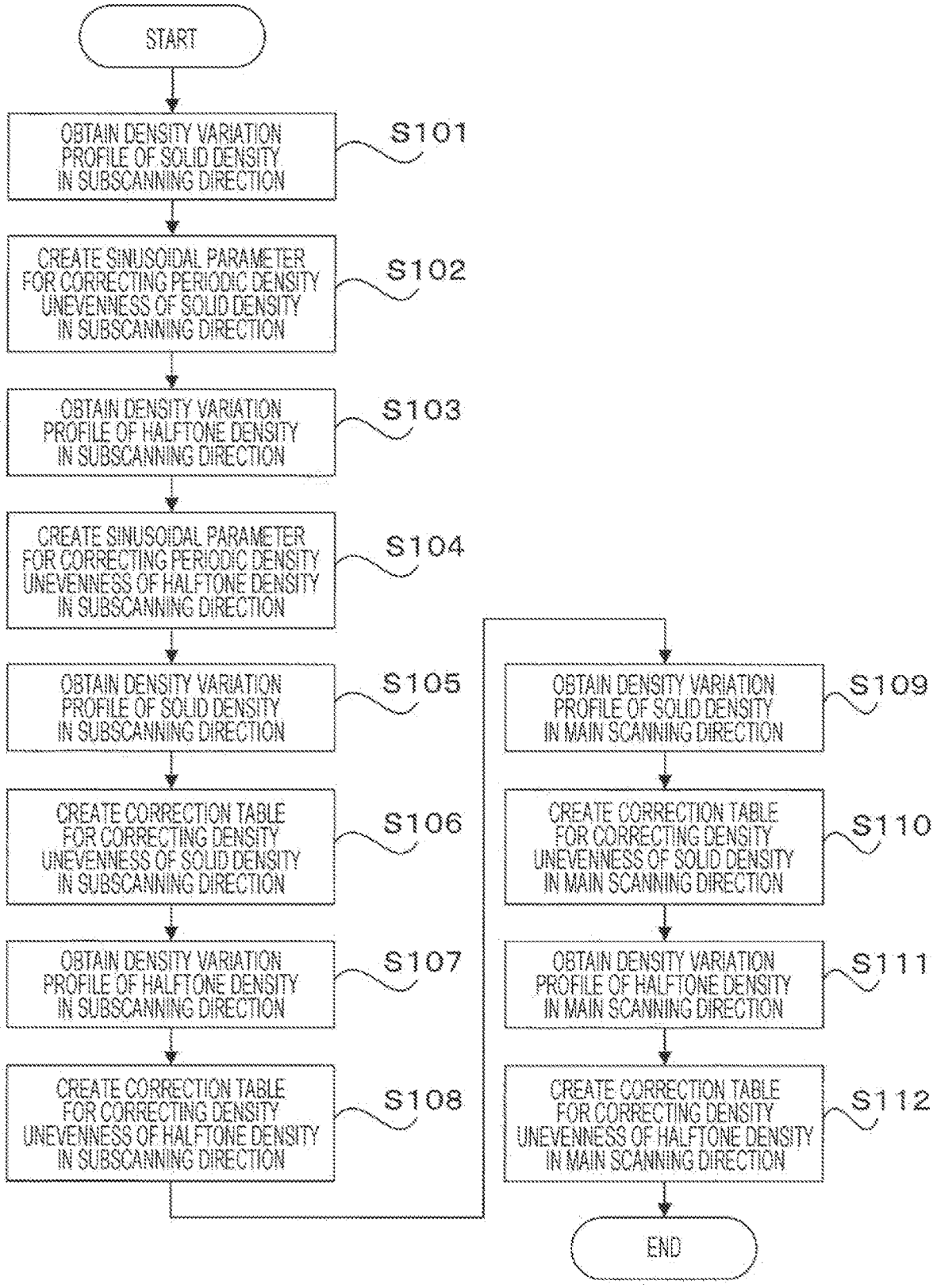
FIG. 6 is a flowchart illustrating an operation of a density correction unit when the density correction unit creates a sinusoidal parameter and a correction table for density correction.

The flowchart in FIG. 6 illustrating an operation of the density correction unit 21 when the density correction unit 21 creates a sinusoidal parameter and a correction table for density correction.

First, in step S101, the image output section forms a patch image having a density near the highest density (Cin≈100%) (hereinafter referred to as a "solid density") onto the intermediate transfer belt 16, and the density sensor 170 detects the density of the patch image, so that the density correction unit 21 obtains a density variation profile that is continuous in the subscanning direction, which is the sheet-transport direction.

Here, the density sensor 170 may be configured to detect not only the density of an unfixed image on the intermediate transfer belt 16 but also the density of an unfixed image on each of the photoconductor rollers 152. The density sensor 170 radiates light onto an unfixed image on the intermediate transfer belt 16 or an unfixed image on each of the photoconductor rollers 152 and detects the intensity of reflected light. Note that the intensity of light reflected by an image fixed to a sheet may be detected by an in-line sensor or a scanner.

Note that the term "Cin" refers to a gradation area percentage expressing gradation in terms of the amount of toner when the maximum usable amount of toner for a certain color is 100%. In other words, the phrase "Cin=100%" refers to the highest density. In addition, the phrase "near the highest density" refers to Cin within a range of 80% to 100%.

Next, in step S102, the density correction unit 21 creates a sinusoidal parameter for density correction on the basis of the obtained density variation profile.

Figure 7:
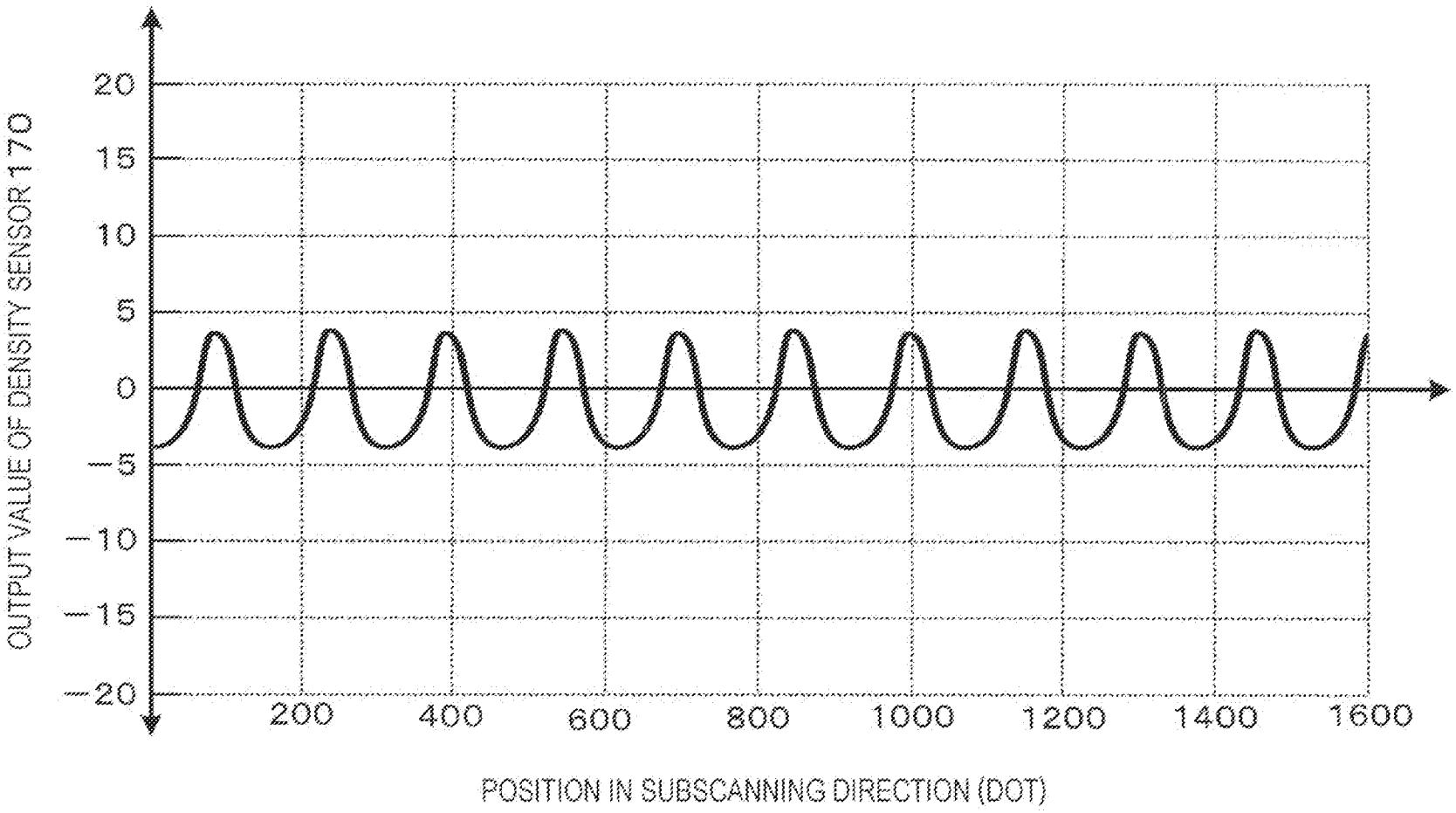
FIG. 7 is a diagram illustrating an example of a waveform of a result obtained by applying a sine wave to a density variation profile detected by a density sensor.

More specifically, the density correction unit 21 performs, on the obtained density variation profile, an inner product calculation of a sine wave and a cosine wave of a period set in accordance with the peripheral length of a rotating body, such as each of the photoconductor rollers 152 or each of the developing rollers 157, or the peripheral speed ratio between members and a higher-order component of the period. The phase and the amplitude when the sine wave is applied to the density variation profile may be obtained from the inner product result. FIG. 7 illustrates an example of a waveform of a result obtained by applying a sine wave to a density variation profile in the manner described above.

The density correction unit 21 calculates the phase difference from the distance between the start of the density variation profile and a Z-phase signal of the rotating body and the period and converts the obtained phase into a phase with respect to the Z phase of the rotating body. Note that the inner product result may be more exactly obtained by using the method of least squares instead of performing an inner product calculation.

Then, the density correction unit 21 shifts the phase by only $\pi$ with respect to the calculated phase and amplitude, and the density correction unit 21 corrects the amplitude in accordance with the input/output response at the time of performing density correction and creates a sinusoidal parameter for density correction. The created sinusoidal parameter is stored in the sinusoidal parameter storing unit 23.

Next, in step S103, the image output section forms a patch image having a halftone density (e.g., Cin≈25%, 50%, or 75%) onto the intermediate transfer belt 16, and the density sensor 170 detects the density of the patch image, so that the density correction unit 21 obtains a density variation profile that is continuous in the subscanning direction, which is the sheet-transport direction.

When the halftone density variation profile is obtained, a patch image may be formed while performing density correction by using the sinusoidal parameter obtained in step S102.

Then, in step S104, the density correction unit 21 creates a sinusoidal parameter for correcting a halftone density on the basis of the halftone density variation profile obtained in step S103. The specific method of creating the sinusoidal parameter is the same as the method described in step S102.

Next, in step S105, the image output section forms a patch image having the solid density near the highest density onto the intermediate transfer belt 16, and the density sensor 170 detects the density of the patch image, so that the density correction unit 21 obtains a density variation profile that is continuous in the subscanning direction, which is the sheet-transport direction.

Note that, in step S105, a density variation profile for correcting density unevenness caused by another factor that is different from periodic density unevenness caused by a rotating body is obtained. An example of a correction target is impulse binding or the like that is caused by, for example, vibration generated when a sheet abuts against a member.

Also in step S105, a patch image having the solid density is formed, and a density variation profile is obtained. However, the density variation profile in this step may be considered as, for example, a portion of a signal having a period starting from a top-of-page signal to the top-of-page signal of the next sheet.

The density correction unit 21 may determine the position of the density variation profile with respect to the top-of-page signal and may obtain a plurality of density variation profiles by repeatedly forming a patch image.

Note that, when the density variation profile is obtained in step S105, a patch image is formed in a state where density correction of periodic density unevenness has been performed by using the sinusoidal parameters created in step S102 and step S104.

Figure 8:
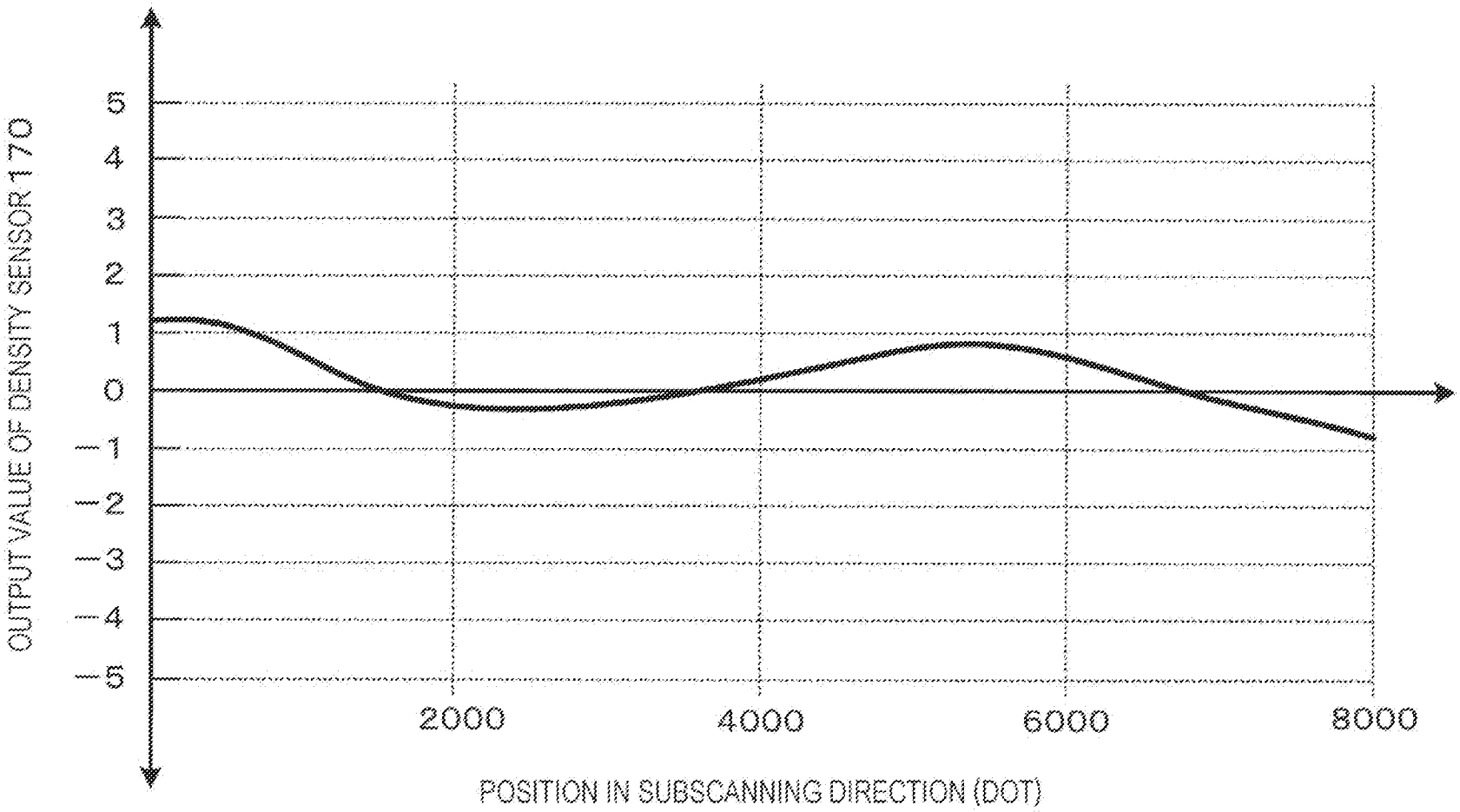
FIG. 8 is a diagram illustrating an example of a density variation profile obtained by averaging density variation profiles from the density sensor on the basis of their positions with respect to a top-of-page signal.

Subsequently, the density correction unit 21 averages the obtained density variation profiles on the basis of the positions with respect to the top-of-page signal. FIG. 8 illustrates an example of a density variation profile obtained in the manner described above.

Then, in step S106, the density correction unit 21 determines a density correction amount by reversing the positive and negative components of the density variation profile obtained in the manner described above and creates a correction table on the basis of the density correction amount.

Figure 9A:
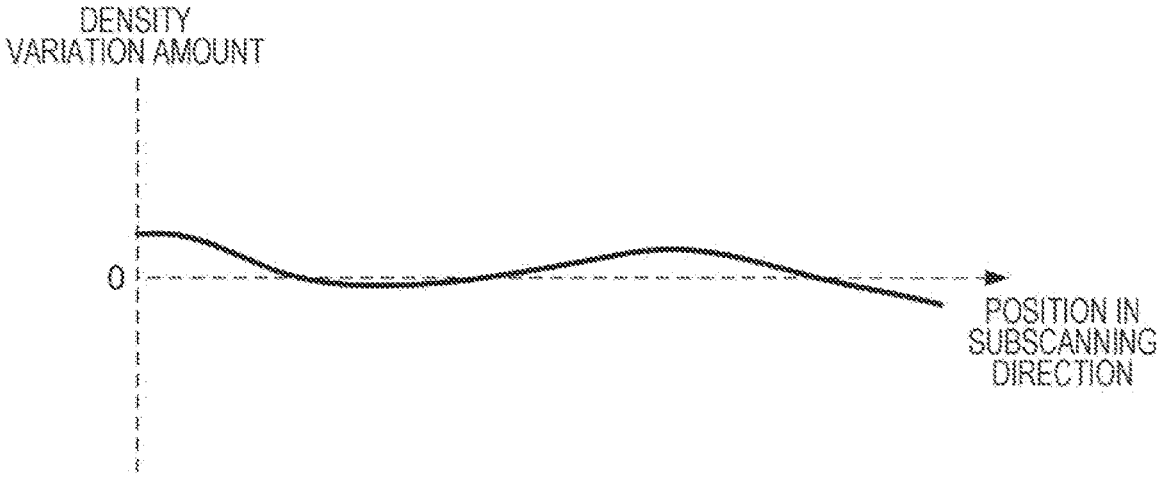
FIG. 9A and FIG. 9B respectively illustrate a density variation profile representing a density variation amount at each position in a subscanning direction and a density correction amount profile in which density variations are canceled by reversing the positive and negative components in FIG. 9A.
Figure 9B:
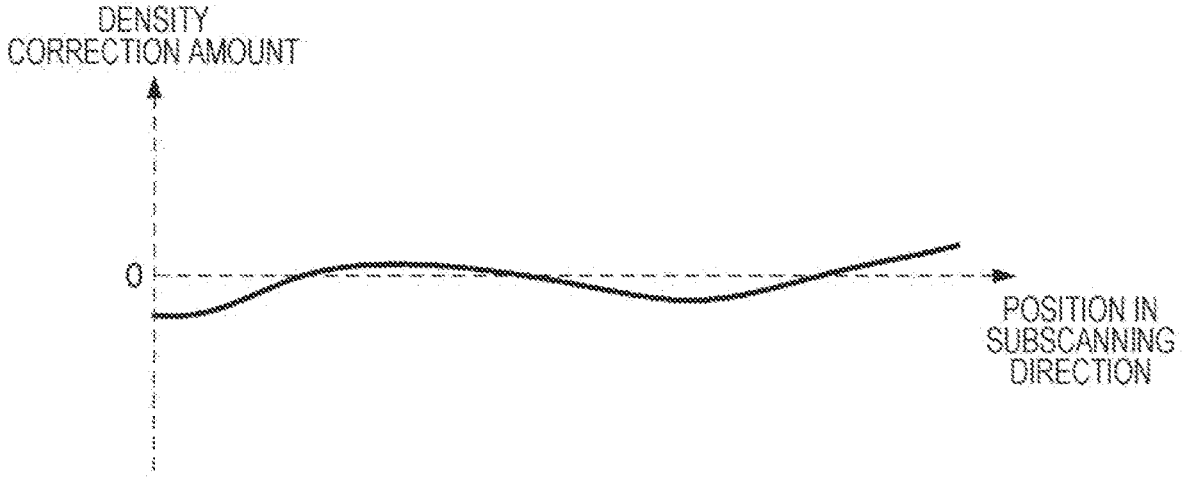

FIGS. 9A and 9B illustrate the case of determining a density correction amount by reversing the positive and negative components of a density variation profile. FIG. 9A and FIG. 9B respectively illustrate a density variation profile representing a density variation amount at each position in the subscanning direction and a density correction amount profile in which density variations are canceled by reversing the positive and negative components in FIG. 9A.

Note that the density correction unit 21 performs the density correction by adjusting the light exposure of each of the exposure units 140, and thus, the values stored in the actual correction table are multiplied by the sensitivity at the time of changing the light exposure.

Next, in step S107, the image output section forms a patch image having a halftone density onto the intermediate transfer belt 16, and the density sensor 170 detects the density of the patch image, so that the density correction unit 21 obtains a halftone density variation profile that is continuous in the subscanning direction, which is the sheet-transport direction. Note that the method of obtaining the density variation profile is similar to the method described in step S105 except with regard to the density of a patch image to be formed.

Note that, when the density variation profile is obtained in step S107, a patch image is formed in a state where density correction of density unevenness has been performed by using the sinusoidal parameters created in step S102 and step S104 and the correction table created in step S106.

Next, in step S108, the density correction unit 21 determines a density correction amount by reversing the positive and negative components of the obtained halftone density variation profile and creates a correction table on the basis of the density correction amount. Here, the specific method of creating the correction table is similar to the above-described method described in step S106. However, a density correction amount stored in the correction table is converted not into a correction amount for adjusting light exposure but into a correction amount for changing a pixel value in an image to be formed.

Next, in step S109, a density variation profile of the solid density in the main scanning direction, which is perpendicular to the subscanning direction, is obtained. Here, the target of density correction is density unevenness in the main scanning direction that repeatedly occurs for each page due to, for example, uneven wear of at least one of the photoconductor rollers 152, a cutting mark formed on at least one of the photoconductor rollers 152, unevenness in the light intensity of at least one of the exposure units 140.

Note that, when the density variation profile is obtained in step S107, a patch image is formed in a state where density correction of density unevenness has been performed by using the sinusoidal parameters created in step S102 and step S104 and the correction tables created in step S106 and step S108.

Then, in step S110, the density correction unit 21 determines a density correction amount by reversing the positive and negative components of the obtained density variation profile of the solid density and creates a correction table on the basis of the density correction amount. Here, the specific method of creating the correction table is similar to the above-described method described in step S106. In addition, regarding a density correction amount that is stored in the correction table, similar to step S106, a correction amount for adjusting light exposure is stored.

Finally, in step S111, a halftone density variation profile in the main scanning direction, which is perpendicular to the subscanning direction, is obtained.

Then, in step S112, the density correction unit 21 determines a density correction amount by reversing the positive and negative components of the obtained halftone density variation profile and creates a correction table on the basis of the density correction amount. Here, the specific method of creating the correction table is similar to the above-described method described in step S106. In addition, as a density correction amounts that are stored in the correction table, a correction amount for changing a pixel value in an image to be formed is stored.

Note that creation of a correction table and creation of a sinusoidal parameter, which have been described above, may be performed at a plurality of positions in the main scanning direction.

FIG. 10 illustrates combinations of a direction of density unevenness, the density of a correction target, a correction-amount storing method, and a correction method when density unevenness correction, which has been described above, is performed.

It is understood from each of the combinations illustrated in FIG. 10 that a correction amount for correcting periodic density unevenness in the subscanning direction that is caused by a rotating body such as each of the photoconductor rollers 152 or each of the developing rollers 157 is stored as a sinusoidal parameter and that a correction amount for correcting density unevenness in the subscanning direction that is caused by a factor other than a rotating body is stored as a correction table.

Note that, although two methods, which are a method of changing light exposure and a method of changing a pixel value, are each provided as a method of correcting density unevenness, the method of changing a pixel value is not usable in the case of performing density correction of the solid density. This is because, in the case of trying to increase a pixel value in an image in order to correct density unevenness, it is impossible to set a gradation area percentage Cin to be greater than 100%, and thus, it is difficult to perform such correction by increasing density. In other words, in the case of performing density correction of the solid density, density correction is performed by changing light exposure.

Figure 11:
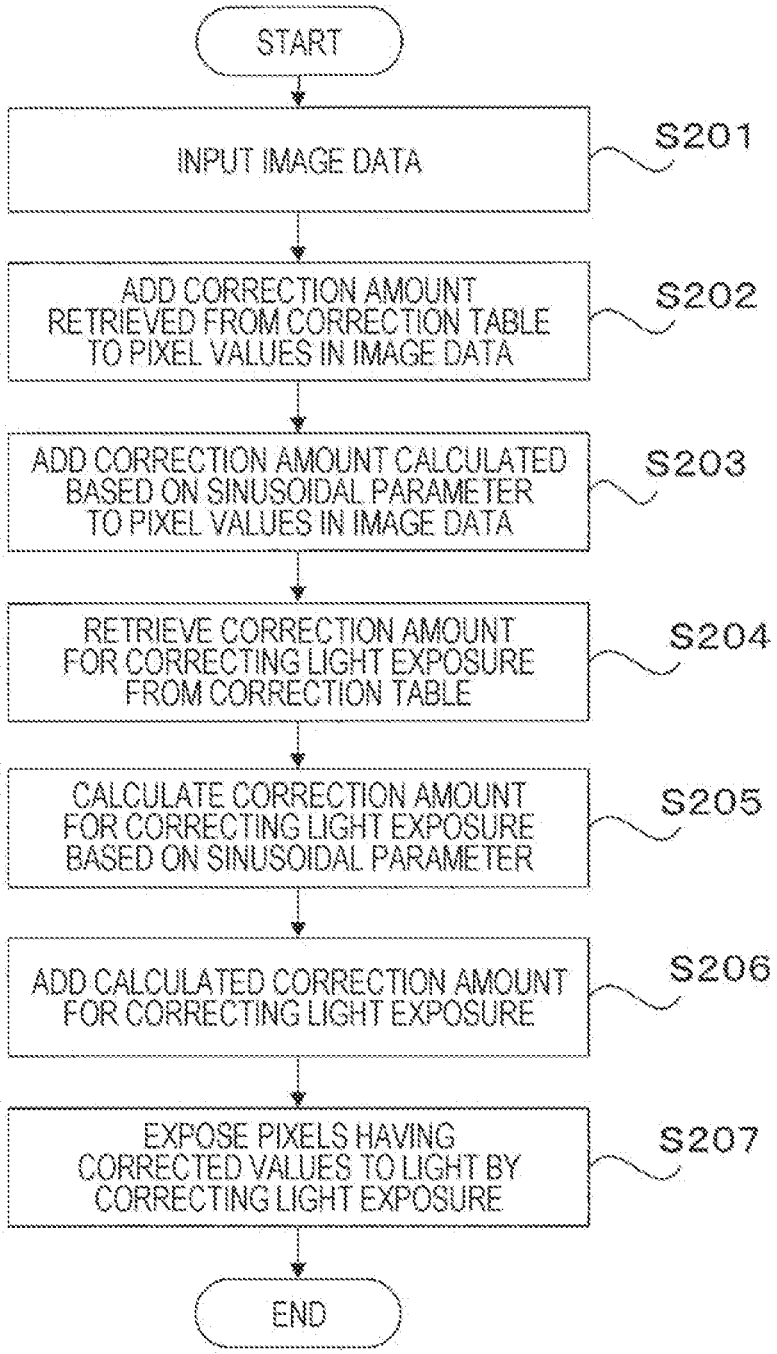
FIG. 11 is a flowchart illustrating processing that is performed when an image is actually formed by using a correction amount for density correction.

Lastly, processing that is performed when an image is actually formed by using a correction amount for density correction calculated in the manner described above will be described with reference with the flowchart illustrated in FIG. 11.

First, in step S201, in response to input of image data for image formation, the density correction unit 21 determines a pixel to be processed.

Then, in step S202, the density correction unit 21 retrieves a correction amount for correcting the pixel value from a correction table stored in the correction table storing unit 22 on the basis of a position in the subscanning direction, a position in the main scanning direction, and a Z-phase signal of a rotating body and adds the correction amount to the pixel value of the pixel to be processed.

Next, in step S203, the density correction unit 21 calculates a correction amount that corresponds to the Z-phase signal of the rotating body on the basis of a sinusoidal parameter stored in the sinusoidal parameter storing unit 23. Then, the density correction unit 21 adds the correction amount calculated on the basis of the sinusoidal parameter to the pixel value corrected by using the correction amount retrieved from the correction table.

Next, in step S204, the density correction unit 21 retrieves a correction amount for correcting light exposure from a correction table stored in the correction table storing unit 22 on the basis of the position of the pixel to be processed in the subscanning direction, the position of the pixel to be processed in the main scanning direction, and the Z-phase signal of the rotating body.

In addition, in step S205, the density correction unit 21 calculates a correction amount for correcting light exposure, the correction amount corresponding to the Z-phase signal of the rotating body, on the basis of a sinusoidal parameter stored in the sinusoidal parameter storing unit 23.

Then, in step S206, the density correction unit 21 adds the correction amount for correcting light exposure, which has been retrieved from the correction table, and the correction amount for correcting light exposure, which has been calculated on the basis of the sinusoidal parameter.

Subsequently, in step S207, the density correction unit 21 corrects, by using the correction amount obtained by performing the above addition, the light exposure when the pixel to be processed is exposed to light by the exposure units 140.

In the above-described density correction method for density unevenness in the subscanning direction, both density unevenness in the solid density and density unevenness in halftones are corrected by using a correction amount calculated on the basis of a sinusoidal parameter. The case where density unevenness in the solid density is corrected by using a correction amount based on a correction table will be described below.

The operation of the density correction unit 21 when density correction of periodic density unevenness in a solid density in the subscanning direction is performed by using a correction table will be described with reference with the flowchart illustrated in FIG. 12.

Figure 12:
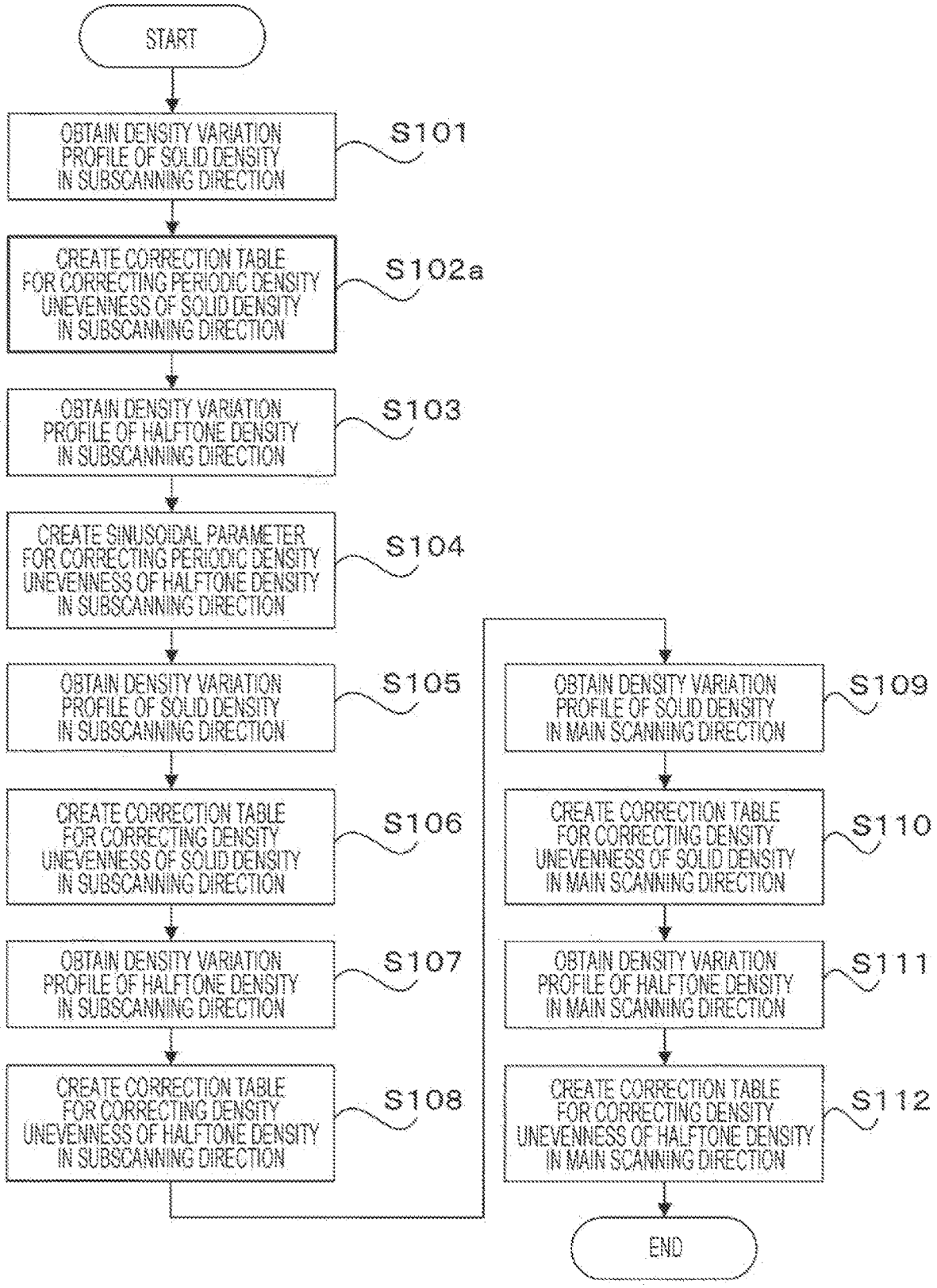
FIG. 12 is a flowchart illustrating an operation of the density correction unit when density correction of periodic density unevenness in a solid density in the subscanning direction is performed by using a correction table.

Note that the flowchart illustrated in FIG. 12 is the same as the flowchart illustrated in FIG. 6 except that step S102 is replaced with step 102*a*, and thus, only step S102*a* will be described.

Also in the flowchart illustrated in FIG. 12, first, in step S101, the image output section forms a patch image having the solid density onto the intermediate transfer belt 16, and the density correction unit 21 obtains a density variation profile that is continuous in the subscanning direction. In this case, the density variation profile is obtained such that a plurality of periods of a rotating body are included in the density variation profile.

Then, the density correction unit 21 creates, on the basis of the obtained density variation profile, a correction table that stores a correction amount for correcting density unevenness in the subscanning direction.

More specifically, the density correction unit 21 divides the density variation profile for each period of the rotating body by referencing to a Z-phase signal of the rotating body and averages the divided density variation profiles on the basis of their positions with respect to the Z phase.

FIG. 13 to FIG. 15B illustrate the case of creating a correction table that stores a correction amount for correcting density unevenness that is caused by at least one of the photoconductor rollers 152.

Figure 13:
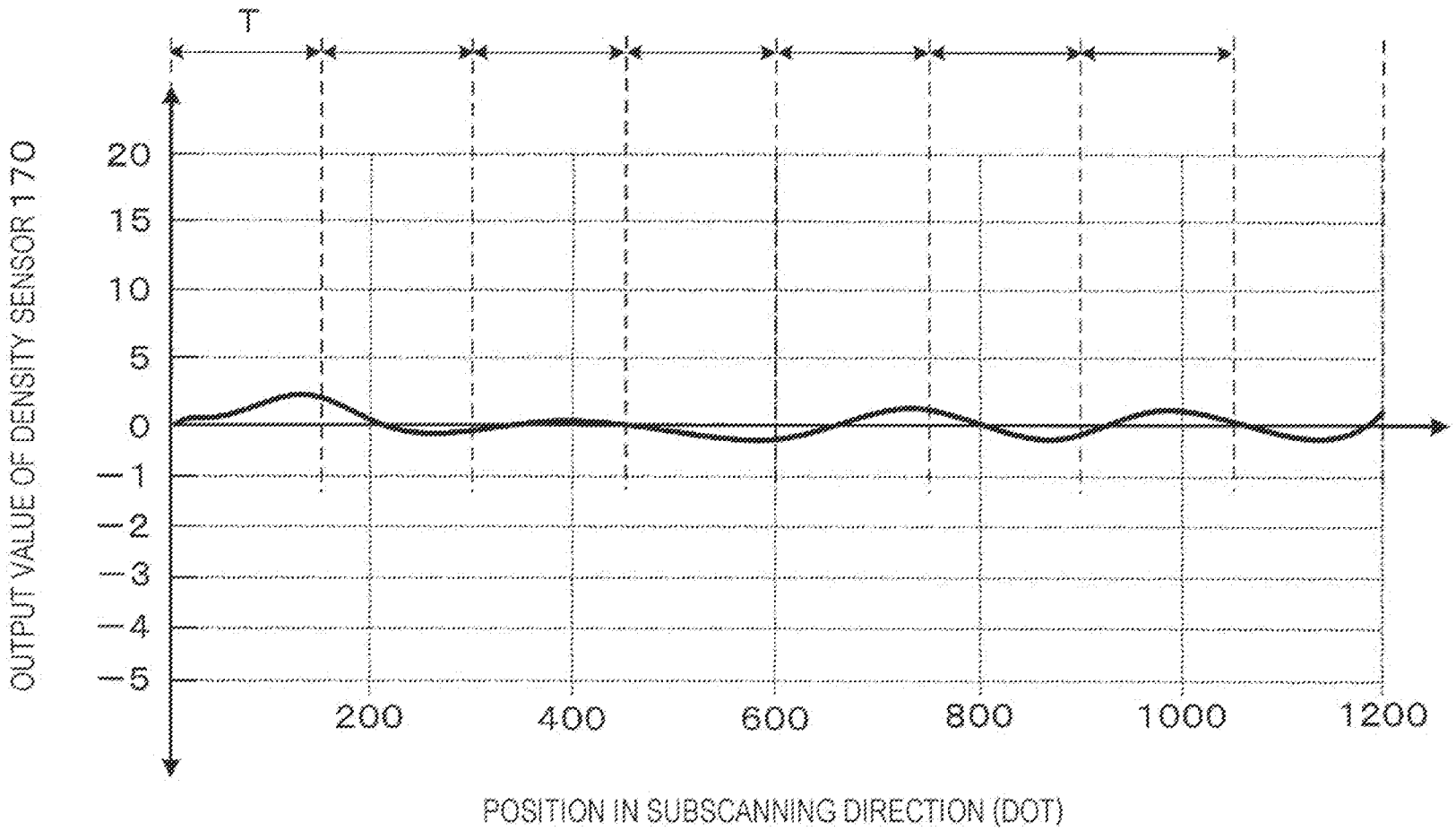
FIG. 13 is a diagram illustrating an example of a density variation profile obtained by the density sensor.

FIG. 13 illustrates an example of a density variation profile obtained by the density sensor 170. The density variation profile illustrated in FIG. 13 includes a plurality of periods T of at least one of the photoconductor rollers 152.

Figure 14:
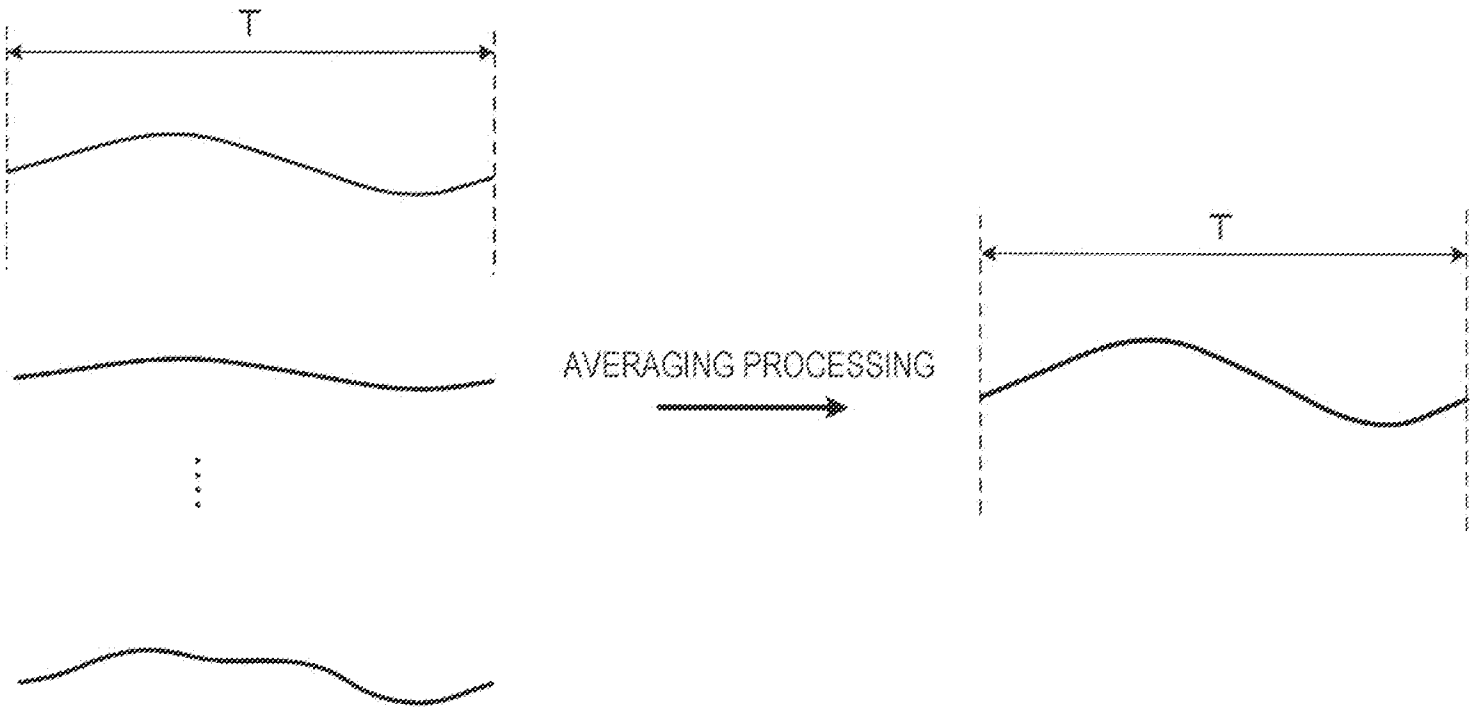
FIG. 14 is a diagram illustrating the state of the density variation profile illustrated in FIG. 13 being divided by a period T of the photoconductor roller and averaged.

FIG. 14 illustrates the state of the density variation profile illustrated in FIG. 13 being divided by the period T of the photoconductor roller 152 and averaged. Referring to FIG. 14, it is understood that a single density variation profile is calculated by averaging the plurality of density variation profiles, which are obtained by dividing the density variation profile illustrated in FIG. 13 by the period T of the photoconductor roller 152.

After that, the density correction unit 21 creates a density correction profile that cancels out density variations caused by the photoconductor roller 152 by reversing the positive and negative components of the density variation profile obtained by the above averaging processing.

Figure 15A:
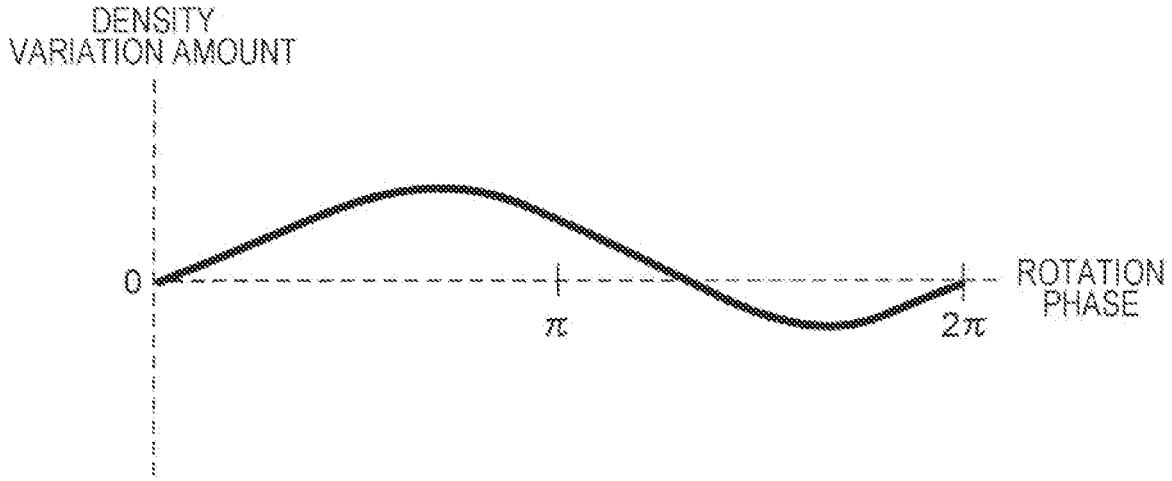
FIG. 15A and FIG. 15B respectively illustrate a density variation profile representing density variation amounts each corresponding to a rotation phase of the photoconductor roller and a density correction amount profile in which density variations are canceled by reversing the positive and negative components in FIG. 15A.
Figure 15B:
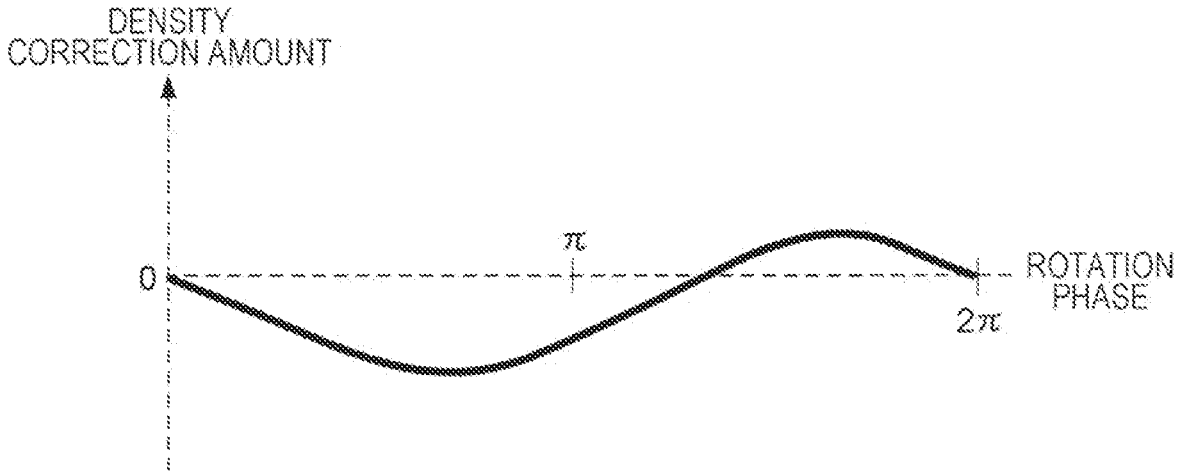

FIG. 15A and FIG. 15B illustrate the case of determining a density correction amount by reversing the positive and negative components of the density variation profile. FIG. 15A illustrates a density variation profile representing density variation amounts each corresponding to a rotation phase of one of the photoconductor rollers 152, and FIG. 15B illustrates a density correction amount profile in which density variations are canceled by reversing the positive and negative components in FIG. 15A.

Note that the density correction unit 21 performs the density correction by adjusting the light exposure of each of the exposure units 140, and thus, the values stored in the actual correction table are multiplied by the sensitivity at the time of changing the light exposure.

FIG. 16 illustrates combinations of a direction of density unevenness, the density of a correction target, a correction-amount storing method, and a correction method when density unevenness correction, which has been described above, is performed.

It is understood from each of the combinations illustrated in FIG. 16 that, among periodic density unevenness in the subscanning direction that is caused by a rotating body, such as each of the photoconductor rollers 152 or each of the developing rollers 157, a correction amount for correcting density unevenness in the solid density is stored as a correction table, and a correction amount for correcting density unevenness in halftones is stored as a sinusoidal parameter.

As described above, only some of correction amounts for correcting periodic density unevenness in the subscanning direction that is caused by a rotating body may be stored as sinusoidal parameters, and the other correction amounts may be stored as correction tables.

Next, the case where a user or a person who is a customer engineer (CE) and who is in charge of maintenance is capable of switching a method of correcting density unevenness will be described.

Figure 17:
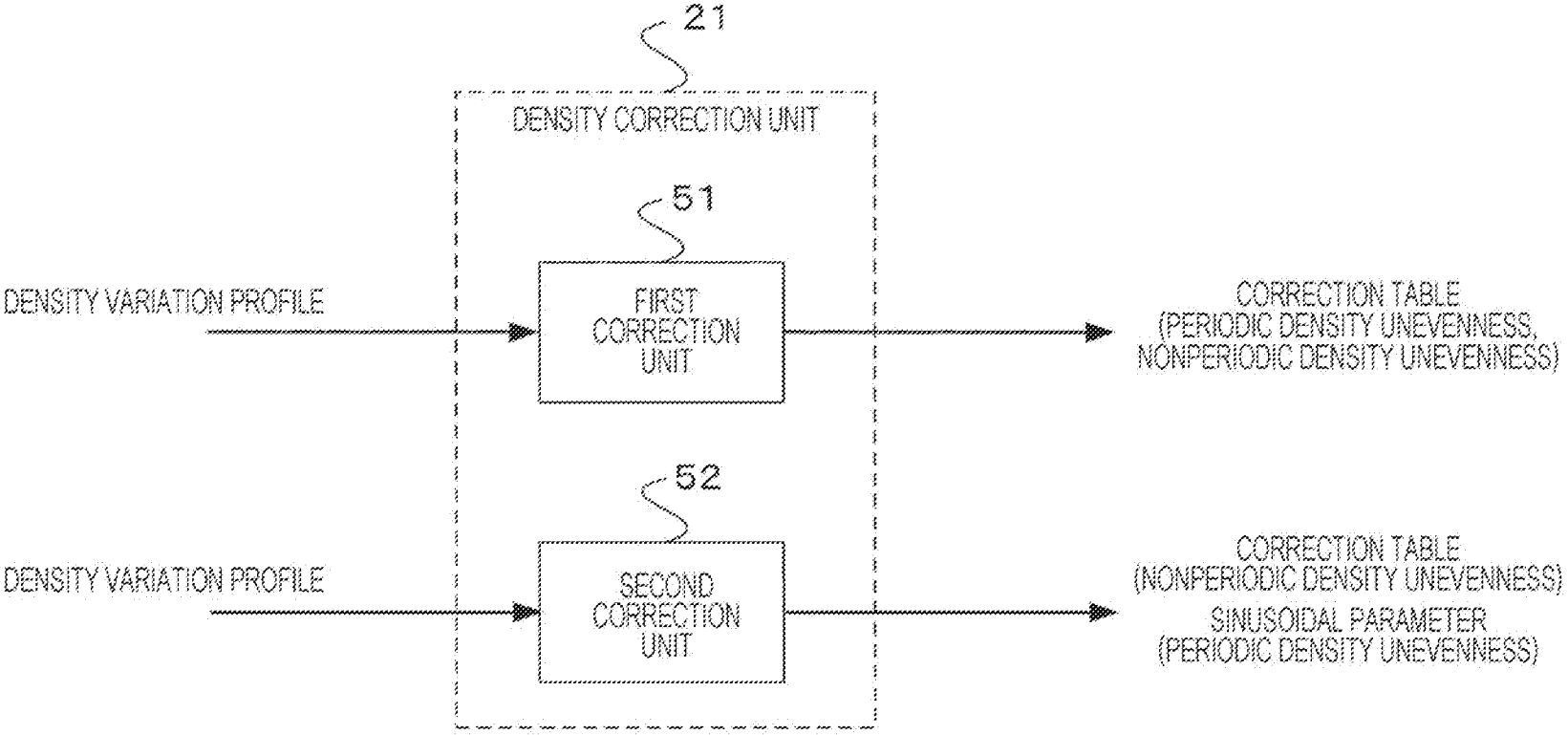
FIG. 17 is a block diagram illustrating an example of the configuration of the density correction unit.

In the following description, for example, the density correction unit 21 includes a first correction unit 51 and a second correction unit 52 as illustrated in FIG. 17.

Here, when a density variation profile that is density variation data obtained as a result of the density sensor 170 detecting the density of a patch image, which is a test image, is input, the first correction unit 51 creates, on the basis of the input density variation profile, a correction table that stores correction amounts for correcting periodic density unevenness due to a rotating body and density unevenness not due to a rotating body.

The second correction unit 52 creates, on the basis of the input density variation profile, a sinusoidal parameter representing a correction amount for correcting periodic density unevenness that is caused by a rotating body and a correction table storing a correction amount for correcting density variations not due to a rotating body.

Figure 18:
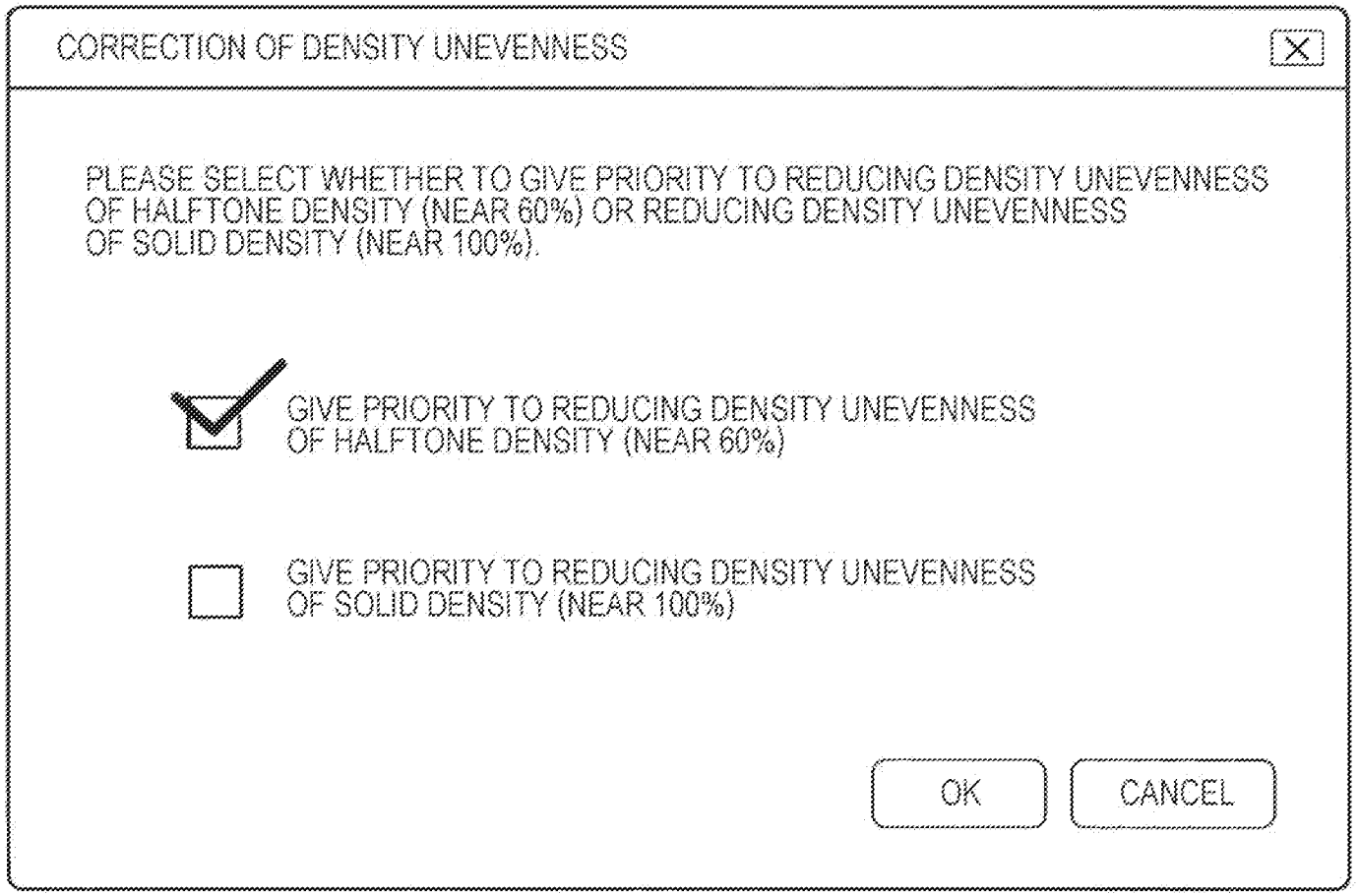
FIG. 18 is a diagram illustrating an example of an operation screen that prompts a user as to whether the user selects a first density correction method that gives priority to reducing density unevenness in halftones or a second density correction method that gives priority to reducing density unevenness near a highest density.

The CPU 41 included in the controller 20 displays, for example, an operation screen such as that illustrated in FIG. 18 on the UI device 45, so that an operation screen that prompts a user as to whether the user selects a first density correction method that gives priority to reducing density unevenness in halftones or a second density correction method that gives priority to reducing density unevenness near the highest density is displayed.

In the case where the first density correction method is selected on the displayed operation screen, the density correction unit 21 inputs a density variation profile created by detecting a halftone patch image to the first correction unit 51 and stores the created correction table into the correction table storing unit 22. Then, when an image is formed in the image output section, the density correction unit 21 retrieves, for pixels in the full range of shades, a correction amount corresponding the rotation phase of a rotating body in the image output section and a correction amount corresponding to a position in the subscanning direction from the correction table and performs correction of the density of an image that is formed onto a recording medium.

Figure 19:
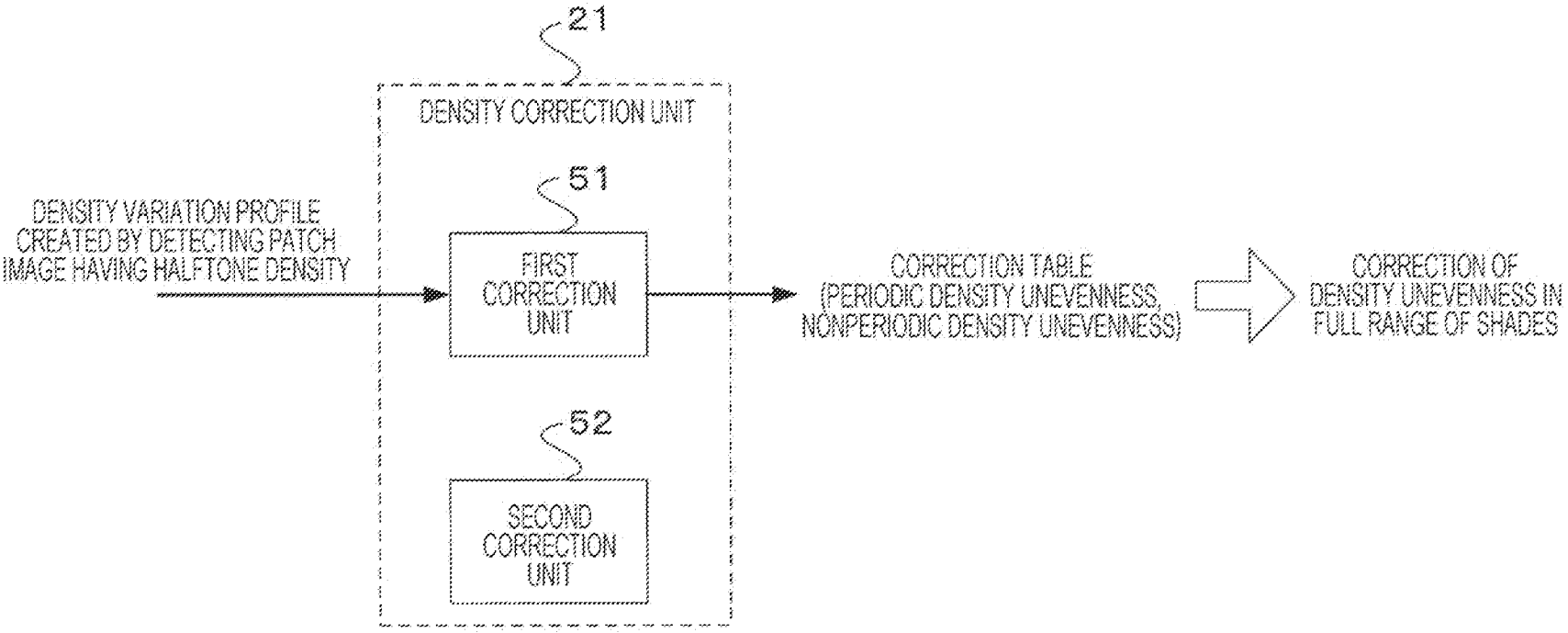
FIG. 19 is a diagram illustrating the operation of the density correction unit when the first density correction method that gives priority to reducing density unevenness in halftones is selected.

FIG. 19 illustrates the operation of the density correction unit 21 when the first density correction method that gives priority to reducing density unevenness in halftones is selected as described above. As seen by referring to FIG. 19, in the density correction unit 21, only the first correction unit 51 performs processing for correcting density unevenness.

In the case where the second density correction method is selected on the displayed operation screen, the density correction unit 21 inputs a density variation profile created by detecting a patch image having a density near the highest density to the first correction unit 51, stores the created correction table into the correction table storing unit 22, inputs a density variation profile created by detecting a halftone patch image to the second correction unit 52, and stores the created correction table and a sinusoidal set value into the correction table storing unit 22 and the sinusoidal parameter storing unit 23, respectively. Then, when an image is formed in the image output section, if the pixel value of a pixel to be formed is near the solid density, the density correction unit 21 retrieves a correction amount corresponding the rotation phase of a rotating body in the image output section and a correction amount corresponding to a position in the subscanning direction from the correction table and performs correction of the density of an image that is formed onto a recording medium. In addition, if the pixel value of a pixel to be formed is in halftones, the density correction unit 21 calculates a correction amount corresponding the rotation phase of a rotating body in the image output section on the basis of a sinusoidal parameter, retrieves a correction amount corresponding to a position in the subscanning direction from the correction table, and performs correction of the density of an image that is formed onto a recording medium.

Figure 20:
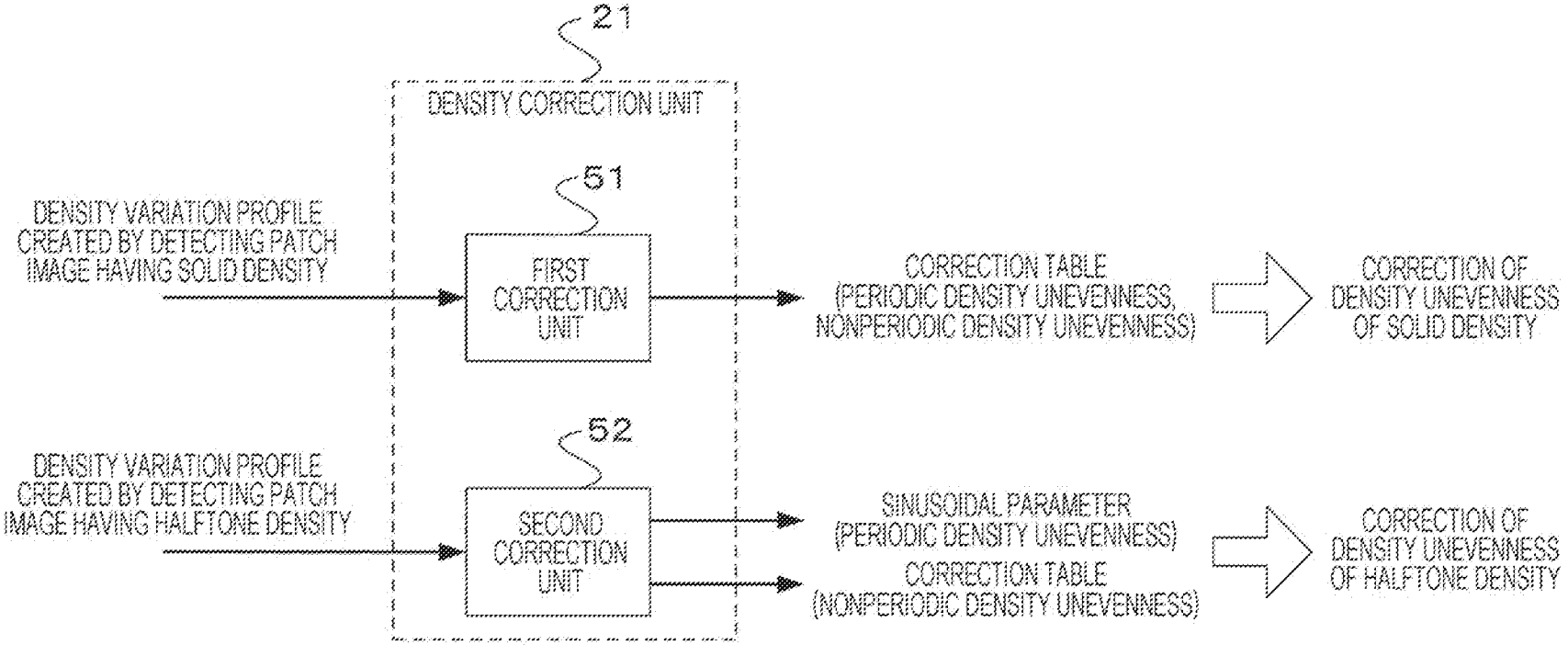
FIG. 20 is a diagram illustrating the operation of the density correction unit when the second density correction method that gives priority to reducing density unevenness near the solid density is selected.

FIG. 20 illustrates the operation of the density correction unit 21 when the second density correction method that gives priority to reducing density unevenness near the solid density is selected as described above. As seen by referring to FIG. 20, in the density correction unit 21, the first correction unit 51 corrects periodic density unevenness and nonperiodic density unevenness in the solid density by using a correction table, and in contrast, the second correction unit 52 corrects periodic density unevenness in a halftone density by using a sinusoidal parameter and corrects nonperiodic density unevenness by using a correction table.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an output section that forms an electrostatic latent image onto an image carrier by using light emitted by a light source and outputs an image onto a recording medium by developing the formed electrostatic latent image;

a memory that stores:

a sinusoidal set value representing a correction amount for correcting periodic density variations that occur in an image, which is to be formed, in a subscanning direction and that are caused by a rotating body; and a correction table in which correction amounts for correcting density variations that occur in an image, which is to be formed, in the subscanning direction and that are not caused by a rotating body are each stored in association with a corresponding position in the subscanning direction; and a processor configured to:

calculate a first correction amount corresponding to a rotation phase of a rotating body included in the output section on a basis of the sinusoidal set value and retrieve a second correction amount corresponding to a position in the subscanning direction from the correction table when an image is formed in the output section; and perform, by using the calculated first correction amount and the retrieved second correction amount, correction of a density of an image that is formed onto a recording medium.

2. The image forming apparatus according to claim 1, wherein, in the correction table, a correction amount for correcting density variations that occur near the highest density among periodic density variations that occur in an image, which is to be formed, in the subscanning direction and that are caused by a rotating body is stored in association with a rotation phase of the rotating body, and wherein the processor is configured to:

perform density correction using the first correction amount, which is calculated on the basis of the sinusoidal set value, when density variations in halftones that occur in the subscanning direction due to a rotating body are corrected; and perform density correction using the second correction amount, which is retrieved from the correction table in accordance with the rotation phase of the rotating body, when density variations that occur near the highest density are corrected.

3. The image forming apparatus according to claim 2, wherein the processor is configured to:

perform density correction by changing a pixel value in an image, which is to be formed, when density correction using the first correction amount is performed; and perform density correction by changing a light exposure of an exposure device included in the output section when density correction is performed on density variations due to a rotating body by using the second correction amount.

4. The image forming apparatus according to claim 3, wherein the rotating body is a photoconductor roller or a developing roller that is included in the output section.

5. The image forming apparatus according to claim 2, wherein the rotating body is a photoconductor roller or a developing roller that is included in the output section.

6. The image forming apparatus according to claim 1, wherein the processor is configured to perform density correction using the first correction amount, which is calculated based on the sinusoidal set value, both in a case of correcting density variations in halftones that occur in the subscanning direction due to a rotating body and in a case of correcting density variations that occur near the highest density.

7. The image forming apparatus according to claim 6, wherein the processor is configured to:

perform density correction by changing a pixel value in an image, which is to be formed, when correction of a halftone density is performed by using the first correction amount; and perform density correction by changing a light exposure of an exposure device included in the output section when correction of density near the highest density is performed by using the first correction amount.

8. The image forming apparatus according to claim 7, wherein the rotating body is a photoconductor roller or a developing roller that is included in the output section.

9. The image forming apparatus according to claim 6, wherein the rotating body is a photoconductor roller or a developing roller that is included in the output section.

10. The image forming apparatus according to claim 1, wherein the rotating body is a photoconductor roller or a developing roller that is included in the output section.

11. An image forming apparatus comprising:

an output section that forms an electrostatic latent image onto an image carrier by using light emitted by a light source and outputs an image onto a recording medium by developing the formed electrostatic latent image;

a first correction unit that creates, on a basis of density variation data input to the first correction unit, a correction table storing correction amounts for correcting periodic density variations due to a rotating body and density variations not due to a rotating body;

a second correction unit that creates, on a basis of density variation data input to the second correction unit, a sinusoidal set value representing a correction amount for correcting periodic density variations due to a rotating body and a correction table storing a correction amount for correcting density variations not due to a rotating body;

a memory; and a processor configured to:

display a screen that prompts a user as to whether the user selects a first density correction method that gives priority to reducing density unevenness in halftones or a second density correction method that gives priority to reducing density unevenness near the highest density;

input density variation data created by detecting a halftone test image to the first correction unit and store a created correction table into the memory when the first density correction method is selected;

retrieve a correction amount corresponding to a rotation phase of a rotating body included in the output section and a correction amount corresponding to a position in a subscanning direction from the correction table and perform correction of a density of an image, which is formed onto a recording medium, when an image is formed in the output section;

input density variation data created by detecting a test image having a density near the highest density to the first correction unit, store a created correction table into the memory, input density variation data created by detecting a halftone test image to the second correction unit, and store a created correction table and a created sinusoidal set value into the memory when the second density correction method is selected;

retrieve a correction amount corresponding to a rotation phase of a rotating body included in the output section and a correction amount corresponding to a position in the subscanning direction from the correction table and perform correction of a density of an image, which is formed onto a recording medium, if a pixel value of a pixel to be formed is near the highest density when an image is formed in the output section; and calculate a correction amount corresponding to a rotation phase of a rotating body included in the output section on a basis of the sinusoidal set value, retrieve a correction amount corresponding to a position in the subscanning direction from the correction table, and perform correction of a density of an image, which is formed onto a recording medium, if a pixel value of a pixel to be formed is in halftones.

12. An image forming apparatus comprising:

means for forming an electrostatic latent image onto an image carrier by using light emitted by a light source and outputting an image onto a recording medium by developing the formed electrostatic latent image;

means for storing a sinusoidal set value representing a correction amount for correcting periodic density variations that occur in an image, which is to be formed, in a subscanning direction and that are caused by a rotating body and a correction table in which correction amounts for correcting density variations that occur in an image, which is to be formed, in the subscanning direction and that are not caused by a rotating body are each stored in association with a corresponding position in the subscanning direction;

means for calculating a first correction amount corresponding to a rotation phase of a rotating body included in the means for forming the electrostatic latent image on a basis of the sinusoidal set value and retrieving a second correction amount corresponding to a position in the subscanning direction from the correction table when an image is formed in the means for forming the electrostatic latent image section; and means for performing, by using the calculated first correction amount and the retrieved second correction amount, correction of a density of an image that is formed onto a recording medium.

* * * * *